US011504866B2

(12) United States Patent
Tsegenidis et al.

(10) Patent No.: US 11,504,866 B2
(45) Date of Patent: Nov. 22, 2022

(54) SHAVER AND METHODS FOR DETECTING SHAVING CHARACTERISTICS

(71) Applicant: Bic Violex S.A., Anoixi (GR)

(72) Inventors: Anestis Tsegenidis, Athens (GR); Nikolaos Chrysanthakopoulos, Athens (GR); Evangelos Skodras, Athens (GR); Ioannis Bozikis, Athens (GR); Spiros Gratsias, Athens (GR)

(73) Assignee: BIC Violex Single Member S.A., Anoixi (GR)

( * ) Notice: Subject to any disclaimer, the term of this patent is extended or adjusted under 35 U.S.C. 154(b) by 113 days.

(21) Appl. No.: 16/623,894

(22) PCT Filed: Jun. 1, 2018

(86) PCT No.: PCT/EP2018/064437
§ 371 (c)(1),
(2) Date: Dec. 18, 2019

(87) PCT Pub. No.: WO2019/001894
PCT Pub. Date: Jan. 3, 2019

(65) Prior Publication Data

US 2020/0316799 A1 Oct. 8, 2020

Related U.S. Application Data

(60) Provisional application No. 62/592,121, filed on Nov. 29, 2017, provisional application No. 62/526,681,
(Continued)

(51) Int. Cl.
*B26B 21/40* (2006.01)

(52) U.S. Cl.
CPC ..... *B26B 21/4056* (2013.01); *B26B 21/4087* (2013.01)

(58) Field of Classification Search
CPC ... B26B 21/40; B26B 21/405; B26B 21/4056; B26B 21/4081; B26B 21/4087
(Continued)

(56) References Cited

U.S. PATENT DOCUMENTS 5,347,715 A * 9/1994 Friedland ..... G06M 3/00 30/526
5,970,831 A * 10/1999 Mattinger ..... B26B 19/40 30/41.7
(Continued)

FOREIGN PATENT DOCUMENTS

CA 2086735 A1 * 1/1993
EP 2245956 A1 11/2010
(Continued)

OTHER PUBLICATIONS

International Search Report and Written Opinion issued in International Application No. PCT/EP2018/064437, dated Oct. 11, 2018 (13 pages).
(Continued)

*Primary Examiner* — Sean M Michalski
*Assistant Examiner* — Richard D Crosby, Jr.
(74) *Attorney, Agent, or Firm* — Bookoff McAndrews, PLLC

(57) ABSTRACT

A shaving system including a shaver having a handle, a razor cartridge, and one or more sensors, wherein the one or more sensors may be configured to detect a characteristic of at least one of the shaver or a body part of a user and to generate a sensor signal representative of the characteristic. A processor may be operably coupled to the one or more sensors and may have at least one algorithm stored thereon for analyzing the sensor signal to determine a status of the shaving session. An indicator may be operably coupled to the processor, and the indicator may be configured to pro-
(Continued)

vide feedback to the user regarding the status of the shaving session.

14 Claims, 16 Drawing Sheets

Related U.S. Application Data filed on Jun. 29, 2017, provisional application No. 62/526,551, filed on Jun. 29, 2017.

(58) Field of Classification Search
USPC ..... 30/32–84
See application file for complete search history.

(56) References Cited

U.S. PATENT DOCUMENTS 6,009,623 A * 1/2000 Orloff ..... B26B 21/4056 30/41.7
6,054,978 A * 4/2000 Perry ..... G06F 3/03543 345/163
6,145,201 A * 11/2000 Andrews ..... B26B 21/22 30/34.05
6,447,448 B1 * 9/2002 Ishikawa ..... A61B 5/4528 600/300
8,545,518 B2 * 10/2013 Grieshaber ..... A45D 26/0061 606/133
11,007,659 B2 * 5/2021 Goldfarb ..... B26B 21/565
2002/0088121 A1 * 7/2002 Jacobsen ..... B26B 21/4056 30/34.05
2002/0189102 A1 12/2002 Orloff
2003/0154832 A1 * 8/2003 Guimont ..... B26B 21/443 83/13
2003/0226258 A1 * 12/2003 Patrick ..... B26B 21/48 30/34.05
2004/0078986 A1 * 4/2004 Guimont ..... B26B 21/44 30/538
2004/0098862 A1 * 5/2004 Orloff ..... B26B 21/521 30/41.7
2007/0050982 A1 3/2007 Freund et al.
2007/0050995 A1 * 3/2007 Schnak ..... B26B 21/526 30/526
2008/0134511 A1 * 6/2008 Salvatore ..... B26B 21/46 30/32
2008/0168657 A1 * 7/2008 Cloke ..... B26B 21/4081 30/32
2008/0244909 A1 * 10/2008 Golan ..... B26B 21/4087 30/47
2009/0000126 A1 * 1/2009 Kraus ..... B26B 19/046 30/34.1
2009/0056141 A1 * 3/2009 Barry ..... B26B 21/40 30/41.7
2009/0071008 A1 * 3/2009 Hart ..... B26B 21/4087 30/34.05
2010/0037463 A1 * 2/2010 Maichel ..... B26B 21/40 30/34.1
2010/0095530 A1 * 4/2010 De Klerk ..... B26B 21/44 30/41.5
2011/0167640 A1 * 7/2011 Flyash ..... A61B 18/1402 30/34.05
2011/0314677 A1 * 12/2011 Meier ..... A46B 13/02 30/41.8
2012/0070905 A1 * 3/2012 Cepus ..... G01N 33/6806 436/163
2012/0167392 A1 * 7/2012 Cherian ..... G01N 33/48785 30/34.05
2012/0227554 A1 * 9/2012 Beech ..... B26B 21/4056 83/13
2014/0312135 A1 * 10/2014 Hyde ..... A47G 23/0216 239/6
2015/0009312 A1 * 1/2015 Verna ..... H04N 5/2257 348/77
2015/0032128 A1 * 1/2015 Tavlin ..... A61N 7/02 606/131
2015/0051845 A1 * 2/2015 Alhashemi ..... B26B 21/4056 702/34
2016/0121495 A1 * 5/2016 Johnson ..... B26B 21/4012 30/532
2016/0167241 A1 * 6/2016 Goldfarb ..... B26B 21/4056 30/41.7
2016/0326732 A1 * 11/2016 McCormick ..... E03C 1/057
2017/0066147 A1 * 3/2017 Ball ..... B26B 21/526
2017/0097758 A1 4/2017 Bauer et al.
2017/0099199 A1 * 4/2017 Bauer ..... H04L 67/22
2017/0232624 A1 * 8/2017 King ..... G01K 1/14 30/34.05
2019/0290359 A1 * 9/2019 Moeskops ..... A61B 18/203
2020/0008715 A1 * 1/2020 Schroeck ..... A61B 5/1121
2020/0316799 A1 * 10/2020 Tsegenidis ..... B26B 21/4056
2021/0128153 A1 * 5/2021 Sgroi ..... A61B 17/1155

FOREIGN PATENT DOCUMENTS

JP H691070 A 4/1994
JP H11290561 A 10/1999
WO WO 2016/094327 A1 6/2016

OTHER PUBLICATIONS

Notice of Reasons for Refusal issued in Japanese Application No. 2019-566172 dated Apr. 15, 2021 with English Translation (10 pages).
Notice of Reasons of Refusal issued in JP 2019-566172 dated Jul. 4, 2022 with English Translation (5 pages).

* cited by examiner

* BATTERY IS DEFINED AS LOW IF IT CANNOT PROVIDE 10 MINS OF A CONNECTED SHAVE
** HERE USER RECHARGES BATTERY WHILE CHARGING LED RED ON
*** FIRST PAIRING REQUIRES EXTRA STEPS OMITTED IN THIS FLOWCHART

SHAVER AND METHODS FOR DETECTING SHAVING CHARACTERISTICS

CROSS-REFERENCE TO RELATED APPLICATIONS

This application is a National Stage Application of International Application No. PCT/EP2018/064437, filed on Jun. 1, 2018, now published as WO2019001894, and which claims the benefit of U.S. Provisional Application Nos. 62/526,681, filed Jun. 29, 2017; 62/526,551, filed Jun. 29, 2017; and 62/592,121, filed Nov. 29, 2017.

TECHNICAL FIELD

Aspects of the present disclosure relate generally to shaving technology, and, specifically, to embodiments of shavers with sensors.

DESCRIPTION OF RELATED TECHNOLOGY

Shavers generally include a handle and a razor cartridge attached to one end of the handle. The razor cartridge includes at least one blade for shaving hair. The user holds the handle and repeatedly moves the razor across an area of the body to be shaved, e.g., the face, until hair is removed from the surface of the body. Although shaving may be a routine part of many people's hygiene regimen, some people may not shave in an efficient manner. For example, some people may over-shave certain areas, leading to skin irritation, while others may cut themselves or miss sections of hair while shaving. Some people may hold their shaver or move their shaver in a manner that increases the likelihood of causing cuts or irritation. Others may have inefficient or erratic stroke techniques that lead to over-shaving and/or under-shaving certain areas. Additionally, as a shaver is used more, the blades dull, reducing the effectiveness of the shaver and increasing skin irritation. Despite this lack of effectiveness, users often continue using shavers with dull blades. Embodiments of the present disclosure may promote better shaving habits and may address some of these issues, as well as others, creating a more efficient and enjoyable shaving experience for users.

Both the foregoing general description and the following detailed description are exemplary and explanatory only and are not restrictive of the features, as claimed. As used herein, the terms "comprises," "comprising," or other variations thereof, are intended to cover a non-exclusive inclusion such that a process, method, article, or apparatus that comprises a list of elements does not include only those elements, but may include other elements not expressly listed or inherent to such a process, method, article, or apparatus. Additionally, the term "exemplary" is used herein in the sense of "example," rather than "ideal." It should be noted that all numeric values disclosed or claimed herein (including all disclosed values, limits, and ranges) may have a variation of +/−10% (unless a different variation is specified) from the disclosed numeric value. Moreover, in the claims, values, limits, and/or ranges means the value, limit, and/or range +/−10%.

SUMMARY OF THE DISCLOSURE

Embodiments of the present disclosure are directed to a shaving system. The shaving system may include a shaver having a handle, a razor cartridge, and one or more sensors, wherein the one or more sensors may be configured to detect a characteristic of at least one of the shaver or a body part of a user and to generate a sensor signal representative of the characteristic. A processor may be operably coupled to the one or more sensors and may have at least one algorithm stored thereon for analyzing the sensor signal to determine a status of the shaving session. An indicator may be operably coupled to the processor, and the indicator may be configured to provide feedback to the user regarding the status of the shaving session.

Various embodiments of the system may include one or more of the following features. The shaver may include two or more sensors, and the two or more sensors may include a proximity sensor and an accelerometer. At least one of the processor or the indicator may be located on a base, and the base may be separate from the shaver. At least one of the processor or the indicator may be located on either a phone or a computer. At least one of the processor or the indicator may be incorporated as part of the shaver. The shaver may include two or more sensors, and at least one sensor may be located on the handle, and at least one sensor may be located on the razor cartridge. The razor cartridge may further include a blade, and at least one of the one or more sensors may be located on the blade.

Embodiments of the disclosure may also be drawn to a shaving system including a shaver having a handle, a razor cartridge, and one or more sensors and a switch for determining when a shaving stroke is taken with the shaver.

Various embodiments of the system may include one or more of the following features. The switch may include two electrical contacts. The two electrical contacts may be configured to transition between a first configuration, in which the two electrical contacts are spaced apart from one another forming an open circuit, and a second configuration, in which the two electrical contacts are in contact with one another forming a closed circuit. The system may further include a processor configured to determine a number of shaving strokes taken with the shaver based on a number of transitions from the second configuration to the first configuration. The processor may be configured to determine a length of each shaving stroke based on an amount of time that the two electrical contacts are spaced apart from one another during a given shaving stroke. The processor may be configured to generate an alert or to automatically place an order for at least one new razor cartridge when the determined number of shaving strokes exceeds a threshold. The processor may be configured to prepare a recommendation for a user to purchase a different razor cartridge based at least in part on the determined number of shaving strokes taken with the shaver.

Additional embodiments of the disclosure may be drawn to a shaving system. The system may include a handle and a cartridge having a skin-contacting surface coupled to the handle. One or more blades may be coupled to the skin-contacting surface. One or more sensors may be configured to detect movement of the skin-contacting surface relative to a skin surface of a user, or a force exerted by the skin-contacting surface against the skin surface of the user.

Various embodiments of the system may include one or more of the following features. At least one of the one or more sensors may include a socket and a ball rotatable within the socket. The system may also include a processor operably coupled to the one or more sensors, and the processor may be configured to determine a number of shaving strokes taken with the one or more blades based at least in part on rotation of the ball within the socket. The processor may be configured to generate an alert or to automatically place an order for one or more new shaving components when the determined number of shaving strokes exceeds a threshold. A processor may be operably coupled to the one or more sensors, and the processor may be configured to analyze a shaving technique of a user based on the detected movement. The processor may be configured to generate an alert based on at least one of a length of a shaving stroke of the user, a frequency of shaving strokes of the user, a tempo of shaving strokes of the user, or a force of the shaving strokes of the user.

BRIEF DESCRIPTION OF THE FIGURES

The accompanying drawings, which are incorporated in and constitute a part of this specification, illustrate the disclosed embodiments, and together with the description, serve to explain the principles of the disclosed embodiments. There are many aspects and embodiments described herein. Those of ordinary skill in the art will readily recognize that the features of a particular aspect or embodiment may be used in conjunction with the features of any or all of the other aspects or embodiments described in this disclosure. In the drawings.

DETAILED DESCRIPTION

Reference will now be made in detail to the exemplary embodiments of the present disclosure described below and illustrated in the accompanying drawings. Wherever possible, the same reference numbers will be used throughout the drawings to refer to same or like parts.

Additional objects and advantages of the embodiments will be set forth in part in the description that follows, and in part will be obvious from the description, or may be learned by practice of the embodiments. It is to be understood that both the foregoing general description and the following detailed description are exemplary and explanatory only and are not restrictive of the claims.

Embodiments of the present disclosure include systems and methods to facilitate and promote efficient shaving techniques and an improved shaving experience, to provide feedback and/or suggestions to a user regarding shaving habits, and/or to help guide a user's shave, e.g., by indicating when a portion of the body is or is not sufficiently shaved. For example, aspects of the present disclosure may include one or more sensors embedded within or placed on a surface of one or more of the handle, the razor cartridge, or the blade of a shaver.

Figure 1:
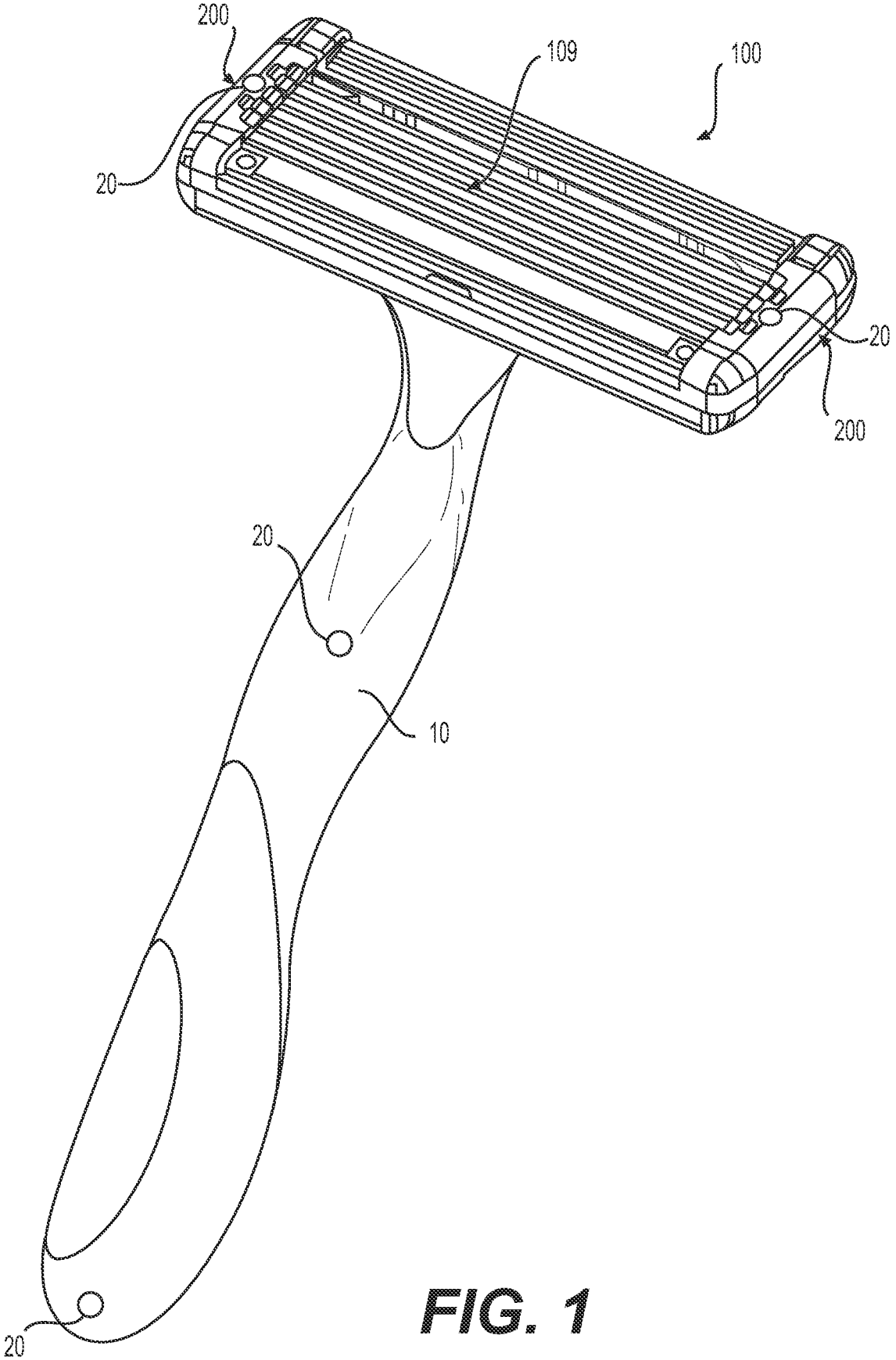
FIG. 1 depicts an exemplary shaving device, according to various embodiments of the present disclosure.

FIG. 1 portrays an exemplary shaver 100. Shaver 100 includes a handle 10 and a razor cartridge 200 having at least one blade 109. Razor cartridge 200 may be releasably secured to handle 10. Shaver 100 may also include one or more sensors 20 configured to collect information about shaver 100 and/or the user during use. For example, sensors 20 may be configured to detect speed, orientation, proximity to the body, moisture, pH, conductance, temperature, and/or pressure. By detecting one or more of these parameters, individual sensor types or combinations of sensor types may provide information about, e.g., how a user is holding the shaver, the proximity of the shaver to the user's body, the orientation of the shaver relative to the user's body, the speed of each shaving stroke, the length of each shaving stroke, what portion of the face each shaving stroke was applied to, the amount of pressure with which the user applies the razor cartridge to the body, the firmness of the user's grip on the handle, and generally the movement of the shaver throughout a shaving session. Such information may help to determine whether a region of the body has been adequately shaved or not. In some aspects, such information may assist in identifying suitable or otherwise appropriate content (e.g., educational or promotional information or videos) for delivery to the user, via, e.g., an associated mobile application loaded on the user's smartphone or other computing device.

To detect the information described above, sensors 20 may each be the same type of sensor, or they may be a combination of different sensor types. For example, sensors 20 may include one or more gyroscopes, accelerometers, pressure sensors (e.g., piezoelectric sensors), light sensors, conductance sensors, temperature sensors, and/or proximity sensors. A gyroscope may provide information regarding the orientation of shaver 100, how a user is holding shaver 100, and/or how many strokes have been applied to a given region of the body. A gyroscope may also indicate whether the shaving stroke is being applied with or against the grain of the user's hair, for example, when combined with body location information, e.g., a map of the user's face. An accelerometer may provide information regarding the speed of shaver 100 (e.g., the speed of a user's shaving stroke) as well as the length of a shave stroke (via, e.g., changes in acceleration indicative of reversing a motion of the shaver). A pressure sensor may provide information regarding how a user is holding handle 10 of shaver 100, how hard razor cartridge 200 is being applied to the body, the evenness of a user's shaving stroke along the body, or the type of hair a user has. The pressure sensor may also be useful in determining whether cartridge 200 is evenly pressed against the user's body. For example, if the razor experiences more resistance as it is moved along the surface of the body, more pressure may be applied to cartridge 200 in the direction of the stroke, and this may indicate a stiffer and/or thicker hair type and/or the presence of more hair on that region of the body.

A light sensor may provide information about where a user is holding handle 10 and/or the proximity of razor cartridge 200 to the body, since light may be blocked by the user's body when shaver 100 is close to the body. A proximity sensor may indicate the proximity of razor cartridge 200 to the body. A conductance sensor may indicate the proximity of razor cartridge 200 to the body, since a user's skin may be conductive. A temperature sensor may detect the temperature of the user's skin. Because the temperature of the skin may fluctuate during the shaving process, the temperature of the skin may serve as an indicator of how thoroughly an area has been shaved. For example, as shaving cream or gel is applied to the skin, the temperature of the skin may drop, and then after one or more strokes with shaver 100, the temperature of the skin may increase. An increase in temperature beyond a certain threshold may indicate that an area of the body has been adequately shaved, and an increase in skin temperature beyond that threshold may indicate skin irritation.

One or more sensors 20 may be operably coupled to a processor to determine this and/or other information. For example, the processor may have software and/or one or more algorithms stored thereon that are configured to receive and analyze raw sensor data. Details of exemplary processors are described further below.

Shaver 100 may include one or more of the above-described sensors and any sensor now known or developed in the future. In addition, the description of the type of information available from each kind of sensor is only for exemplary purposes and is not limited to the description above. One or more sensors may be configured to provide the same or substantially similar information, regardless of the description above.

If combinations of different types of sensors are used, more precise information may be available or more types of information may be available. For example, combining a proximity sensor and a gyroscope may provide information regarding not only the orientation of shaver 100, but also the relative orientation of shaver 100 to the body. Combining a proximity sensor and an accelerometer may provide more exact information about what portion of the user's stroke actually contacts the body and at what speed shaver 100 is traveling when contact is made, which may help to assess how much a portion of the body has been shaved, and whether that portion of the body needs additional shaving or whether no additional shaving should occur there. Adding a temperature sensor may provide additional information about how many times shaver 100 has passed over the user's skin in that area.

Combining an accelerometer and a gyroscope may provide information regarding how fast and at what angle a user approaches his or her body with shaver 100 and/or how fast and at what angle a shaving stroke is applied to the body. This combination of data may provide information regarding the effectiveness of an individual shaving stroke, and may provide information about how likely it may be that a user cuts a certain amount of hair with that stroke, or the likelihood that the user cuts him or herself using that shaving technique. The combinations of sensors provided herein are exemplary only, and it is contemplated that additional combinations of sensor types may be used to provide additional information. In addition, although combinations of two different sensor types are mainly described, three or more different types of sensors may be included on shaver 100.

One or more sensors 20 may be located on any suitable region of shaver 100. For example, one or more sensors 20 may be located on handle 10, razor cartridge 200, and/or one or more blades 109. Sensors in these locations may indicate, for example, the location and/or efficiency of a shaving stroke. In some embodiments, sensors 20 may be located on handle 10 and may indicate the orientation of shaver 100, the relative positioning of shaver 100 compared to the body, and/or how the user is holding handle 10 of shaver 100. Including multiple sensors 20 at different locations along the handle may provide more information regarding the orientation of shaver 100. For example, including multiple gyroscope sensors 20 may help to ascertain whether the user is tilting shaver 100 and razor cartridge 200 towards or away from the body and at what angle.

In some embodiments, one or more sensors 20 may be included on razor cartridge 200 in addition to or instead of handle 10. For example, one or more proximity sensors 20 may be included on razor cartridge 200 to detect when razor cartridge 200 is near or in contact with the body of a user. One or more temperature sensors 20 may be included on razor cartridge 200 to detect the temperature of the skin (e.g., is it irritated or not) as blades 109 contact the user's body and/or to detect whether razor cartridge 200 is in contact with the body. Any suitable number of sensors 20 may be included on shaver 100 at any suitable location(s). Further, sensors 200 may be located on a surface of shaver 100 or may be embedded within shaver 100.

In some embodiments, it is also contemplated that sensors 20 could be included on an element separate from shaver 100 configured to attach and detach to shaver 100, rather than being directly incorporated in or on shaver 100. In this way, a sensor system may be interchangeably used with a variety of different shavers 100.

Shaver 100 may also include one or more timers and/or global positioning systems (GPS). For example, a timer may help to determine the speed of a given stroke and/or the amount of time a user has spent shaving a particular region of the body. This may help to indicate the sufficiency of shaving in that area. The speed of each stroke and/or time spent may also indicate the thickness of body hair and/or the type of hair being shaved, information that may be useful to determining the adequacy of a shave and/or suitability of a particular cartridge 200 and/or blades 109 for a particular user. A timer may also be used to determine a user's total time spent shaving. A GPS may help to determine the location of shaver 100 relative to a user's body, its orientation, and/or it's path of travel along the user's body. Again, this data may provide information to help determine whether a particular area of the body needs more shaving or not. For convenience, timer and GPS will each be referred to herein as a type of sensor 20.

The data detected using one or more sensors 20 may be analyzed to indicate whether regions of the user's body have been shaved the appropriate amount (e.g., whether a spot has been missed, whether a clean shave has been achieved, or whether additional shaving is unnecessary or may cause irritation) and/or with the appropriate number of strokes. In some embodiments, whether the appropriate number of strokes have been applied may take into account the angle at which the strokes were applied to the body and/or the pressure at which the strokes were applied. For example, if more pressure is applied, then less strokes may be needed to achieve an adequate shave. However, the application of more pressure by the user may also indicate a dull blade, which may affect the number of strokes needed to achieve an adequate shave. In some embodiments, the direction of the strokes may be taken into account to determine sufficiency of shaving, for example, whether the strokes were applied with or against the grain.

Determining the adequacy of shaving in a given body region may also take into account information not detected by shaver 100, for example, the type of hair a user has, the user's desired level of shave (e.g., whether the user wants stubble remaining, wants a clean shave, or wants to leave hair remaining in certain areas). Other information may include the type of cream or gel applied, the user's shaving history, the shape of the user's body, the density of hair on the user's body, the use history of blades 109 (e.g., how sharp or new they are), the type of shaver 100 used, the user's skin characteristics (e.g., normal, dry, or sensitive), the user's age (which may affect, e.g., the sensitivity of the user's skin or the quality of the hair), or any other suitable information or combination of information. Some or all of this information may be input by the user and assessed along with data from sensors 20, as will be described further below.

In some embodiments, data detected by shaver 100 may be analyzed in conjunction with images of the user taken before and/or during a shaving session. The data may be analyzed in conjunction with images and/or mapping of the region of the user's body to be shaved, e.g., the face. For example, before shaving takes place, a user may download an application on his or her smartphone or computer 550. The application may prompt the user to take or upload one or more photographs of the relevant body part to be shaved. In some embodiments, the application may request photographs taken at multiple different angles and/or of close-up and/or wide-angle views of the user's body region. The application may additionally or alternatively request video of the body region, e.g., as the camera is moved at different angles relative to the body region, or as the user moves the body region relative to the camera. The camera device used to capture user images may be the camera built into or connected to a smartphone or computer 550, or a separate camera, from which the images may be downloaded and then uploaded to the application via a hard or wireless connection.

The photographic information may be stored in a database, and, based on the photographic information, a three-dimensional (3D) model of the user's face may be generated. In some embodiments, particular landmarks and/or digital flag posts may be generated corresponding to anatomical features. In some embodiments, the body region photographed may be broken up into shaving regions. For example, a user may define which areas of the body region are to be shaved, or the application may automatically break the image up into regions that represent the average shaving patterns of people generally or of that particular user.

During shaving, data generated by sensors 20 of shaver 100 may be correlated to stored photographic data for the user's body region. Thus, information regarding the location of shaver 100 relative to the body region and/or the number of shaving strokes applied may be correlated to the 3D map of the user's body region. In this way, the application may be able to track how much different portions of the user's body region have been shaved and how much additional shaving, if any, should be performed by the user before an adequate shave has been achieved in that body region.

As discussed above, additional information not detected by sensors 20, for example, the user's hair type, hair thickness, desired level of shave, etc., may also be considered in conjunction with the 3D map of the body region and/or the data from sensors 20 in order to assess the sufficiency of a shave in a particular body region.

Figure 2:
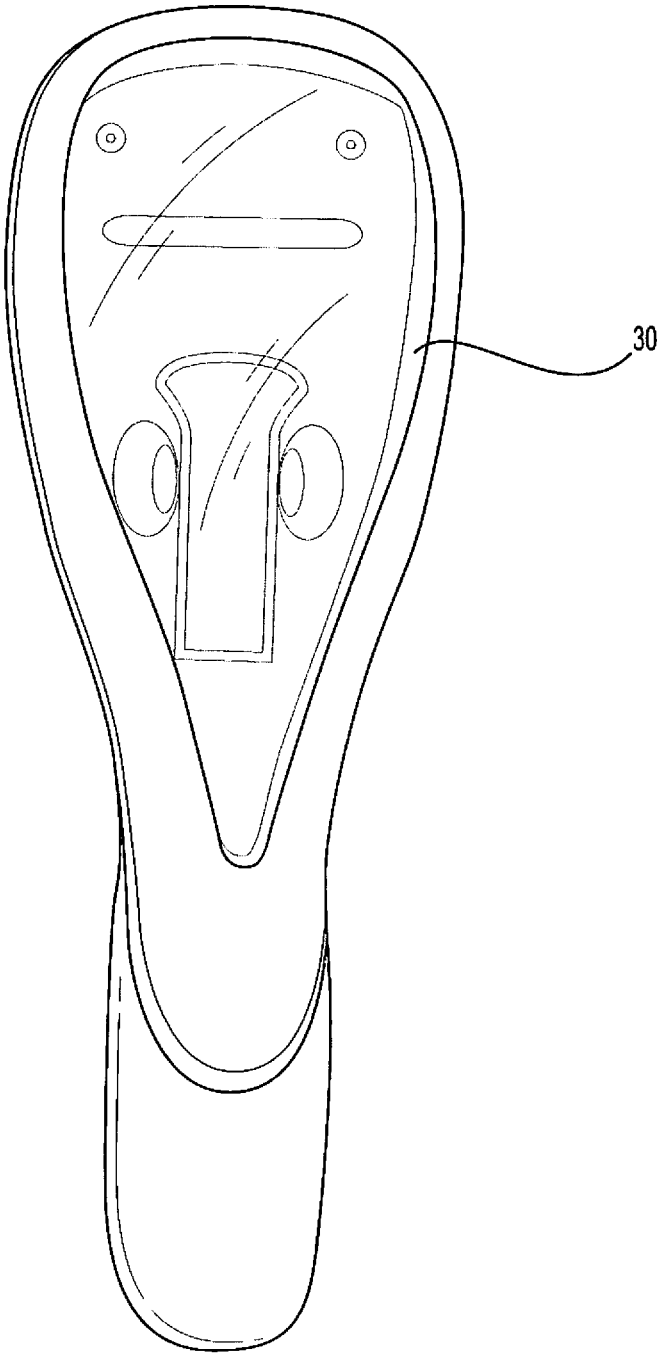
FIG. 2 depicts an exemplary base, according to various embodiments of the present disclosure.
Figure 3:
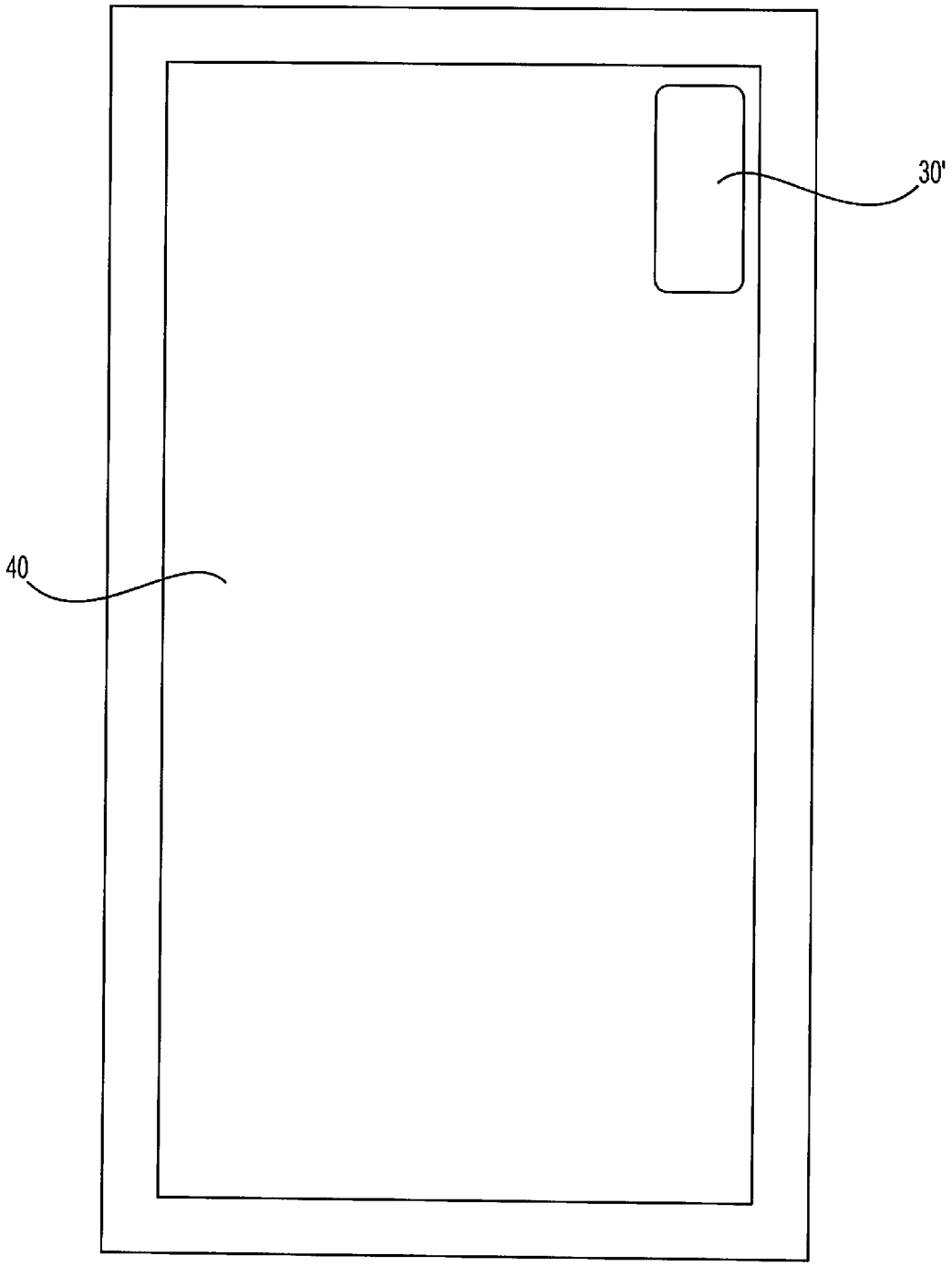
FIG. 3 depicts an exemplary base mounted on a mirror or other suitable surface, e.g., a wall in a user's bathroom, according to various embodiments of the present disclosure.

In exemplary embodiments, it is contemplated that images of the region to be shaved may be captured during the shaving process. For example, in some embodiments, camera technology and/or scanning technology may be incorporated as part of shaver 100 and/or a base 30, e.g., a recharging base on which the razor may rest when not in use. An exemplary base 30 is depicted in FIG. 2. Although base 30 in FIG. 2 is designed to receive shaver 100, base 30 may be any suitable size and/or shape and may or may not be configured to hold shaver 100. In some embodiments, a separate base may be configured so that the user can attach or sit the base on, e.g., a shelf, sink, cabinet, mirror, or any suitable surface that is in view of the user during a shaving session. For example, FIG. 3 shows an exemplary base 30' mounted on a mirror 40. An exemplary base may include, e.g., a camera and/or a laser that may scan the body region of the user being shaved before and/or during shaving. The scanning may be intermittent or continuous before and/or during the shaving session. The additional information captured by the base may include, e.g., the region of the body being shaved, the progress of the shaving session, and/or the user's shaving technique. In some aspects, the 3D map generated by the original photographic information may be updated by the images captured by the base, or a new 3D map may be generated from the images captured by the base. In some embodiments, the information captured by the base may be analyzed along with data from sensors 20, data uploaded to the application by the user, and/or previously acquired images of the body region being shaved (e.g., images of the user originally uploaded to the application).

In some embodiments, the user may use his or her smartphone, computer, or other camera device to capture images of the region of the body being shaved before and/or during a shaving session, in addition to or instead of a base. This information may be used as described above in reference to the base.

In some embodiments, shaver 100 may include imaging technology, e.g., laser scanning or camera scanning technology, that may capture data about the region of the body being shaved. For example, as shaver 100 is used to shave a region of the body, shaver 100 may capture scanned data about the location currently being shaved, the amount of hair on the area being shaved, or other suitable information. Again, this information may be analyzed in conjunction with data from sensors 20, data uploaded to the application by the user, and/or previously acquired images of the body region being shaved (e.g., images of the user originally uploaded to the application).

Data captured by sensors 20; imaging information uploaded by a user; data captured by scanning or camera technology on shaver 100, a separate base, and/or an external camera (on a smartphone, computer, etc.); and/or data input by a user may be stored in a memory and/or analyzed by a processor to determine whether a region of the body has been adequately shaved. In some embodiments, data from sensors 20 and/or scanning technology on shaver 100 may be transmitted to a separate base and/or to a smartphone or computer 550. In some embodiments, information captured by scanning technology on a separate base may be transmitted to a smartphone or computer 550 or stored in memory on the base. Information captured by an external camera or a smartphone or computer 550 camera may be transmitted to an external base or transmitted and/or maintained on the smartphone or computer 550. In exemplary embodiments, information input by a user, data from sensors 20, and/or other scanning or imaging data may be transmitted to a base, a computer, or a smartphone having a processor equipped with software configured to analyze the received data to determine whether a region of the body has been sufficiently shaved, whether more shaving in a particular area is suggested, and/or whether a region of the body has been over-shaved. The processor and/or memory may be located on any component of the shaving system, for example, shaver 100, a base, a smartphone, or a computer, and the components of the shaving system may transmit any stored or detected data to the processor for analysis.

Based on the analysis of this data, one or more components may provide indication to the user regarding the sufficiency of shaving. The indication may be provided via an application downloaded onto a phone. For example, a user may open the application on a computer or smartphone prior to commencement of shaving. As the user shaves, information about the shaving session may be generated and analyzed, and the results of the analysis may be displayed to the user via the application. For example, a picture of a face may appear on the application, and areas of the face may be indicated to the user as requiring more shaving or as being sufficiently shaved. Charts, text, colors, lights, pictures, or other suitable visual aids may indicate where the user does and does not need to shave, the percentage of shaving left or accomplished in a given area, or other suitable feedback. In some embodiments, the application may provide auditory or tactile feedback instead of, or in addition to, visual feedback; for example, a vibration or sound may indicate that a region of the body has been adequately shaved. In some embodiments, a voice may direct the user as to where to shave and where not to shave.

In some embodiments, lights, noises, vibrations, and/or other visual, tactile, or auditory feedback may be provided on a separate base. For example, a light may go on when an area is sufficiently shaved, or a light may turn from green to red to indicate whether to shave more or to stop shaving a given region. Or a screen on the base may show similar visual indicators as those described above in reference to the application, or a vibration or sound may be generated by the base as described above. In some embodiments, a voice may direct the user as to where to shave and where not to shave.

In some embodiments, the feedback described above may be incorporated into shaver 100. For example, shaver 100 may vibrate or emit a sound when a body region is sufficiently shaved, lights may indicate the sufficiency of shaving for a given area, and/or a screen may indicate the whether or not an area needs to be shaved, e.g., by providing a percentage level or other suitable indication. In some embodiments, a voice may direct the user as to where to shave and where not to shave.

In this way, using shaver 100 may provide a user with real-time feedback regarding where to shave, where not to shave, and/or the progress of a shaving session. This guidance and feedback may help to guide a shaving session so that portions of the body region are not under-shaved or over-shaved to decrease the risk of irritation and/or missing a section of hair. It is also contemplated that more than one component of the shaving system may provide feedback to the user.

It is also contemplated that other feedback may be provided to the user. For example, shaving tips, such as how to hold shaver 100, whether to slow down or speed up a shaving stroke, what angle at which to approach the body with shaver 100, how much more or less pressure to apply with shaver 100 on the body region, or other suitable feedback or suggested shaving techniques may be provided to the user, in addition to adequacy of the shave. Feedback may also include suggestions relating to differing handles, cartridges, or blades determined to be more suitable for a particular user based on, e.g., the user's shaving habits or hair type. This information may help to optimize the user's shaving experience and to provide the user with a more efficient and/or comfortable shaving experience.

Shaver 100 may include a disposable or rechargeable battery to power sensors 20 and/or to power a camera or scanner, haptic feedback device, lights, screen, or other indicator that may be included in shaver 100. In some embodiments, shaver 100 may have an on/off switch, button, or device for a user to engage prior to use. In other embodiments, shaver 100 may have auto-on capabilities, e.g., in response to movement or gripping by the user or detachment of shaver 100 from a stand or base.

Figure 4:
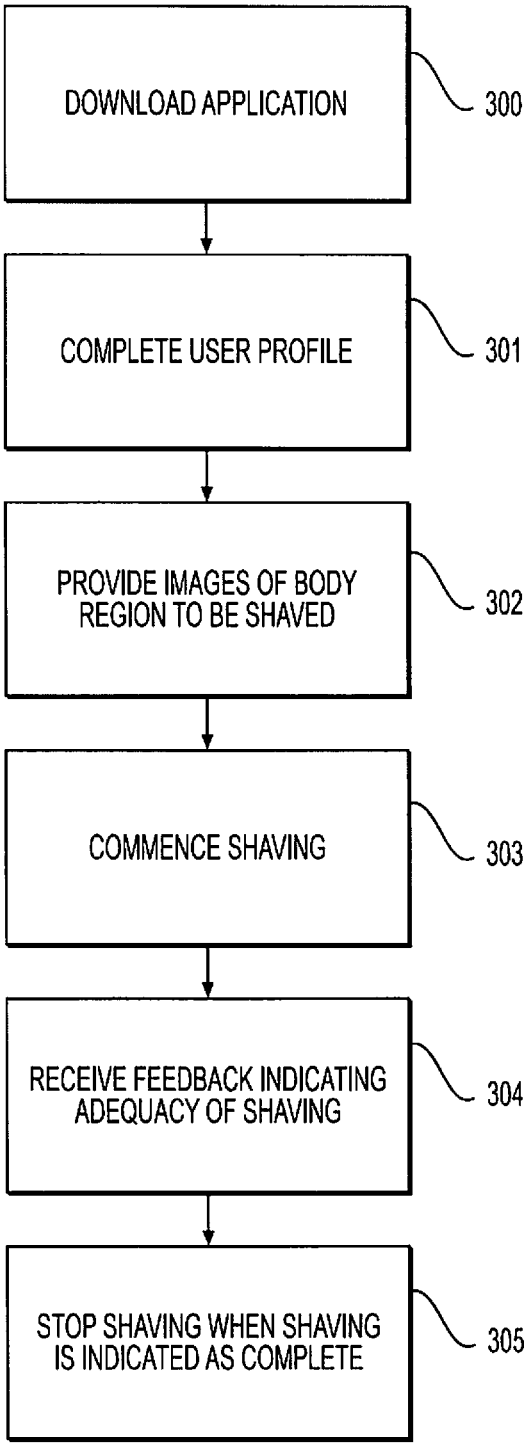
FIG. 4 is a flow chart portraying an exemplary shaving method, according to various embodiments of the present disclosure.

An exemplary shaver 100 may be used in the manner shown in FIG. 4. Those of ordinary skill in the art will recognize that one or more steps of the method depicted in FIG. 4 may be omitted or performed out of the order depicted in FIG. 4. First, a user may download a shaving application to a smartphone or computer 550, step 300. A user may then complete a user profile, step 301. Completing a user profile may include answering a series of questions or prompts. Exemplary questions in a user profile may include questions regarding type of hair a user has, the user's desired level of shave (e.g., whether the user wants stubble remaining, wants a clean shave, or wants to leave hair remaining in certain areas), the type of cream or gel typically used, the user's shaving history, the shape of the user's body, the density of hair on the user's body, the use history of the user's blades 109 (e.g., how sharp or new they are), the type of shaver 100 the user has, the user's skin characteristics (e.g., normal, dry, or sensitive), the user's age (which may affect, e.g., the sensitivity of the user's skin or the quality of the hair), or any other suitable information or combinations of information. The user may input information via any suitable means. For example, the user may type information into the shaving application or activate a camera to scan a bar code of the shaver type. The user may be able to go back into the application and modify the answers at a later date, e.g., if the answers to the questions change over time.

The method may also include providing one or more images of a region of the body to be shaved, step 302. This may include uploading existing pictures or videos and/or generating new pictures and/or videos using one or more of a smartphone, computer, external camera, or shaver base, as described above. It is contemplated that steps 301 and 302 may be interchangeable. More over, steps 301 and 302 may be omitted altogether if the user has a preexisting shaving profile.

Once the user profile is complete with images and information, the user may commence shaving, step 303. As discussed above, images of the region to be shaved may be captured during the shaving process. Is some embodiments, if the images captured during the shaving process do not match the images previously acquired by the user and stored in the user's profile, then the user may be prompted by the application to take new profile images when the user has finished shaving. This may occur, for example, if the user has gained or lost weight, has had surgery, and/or has had an injury or other change that has affected the contours of the body region to be shaved.

As the user shaves, he or she may receive feedback from shaver 100, a separate base, and/or the application to determine the adequacy of shaving in a given area, step 304. Based on the feedback, the user may continue or discontinue shaving in a certain area of the body region. The user may repeatedly perform steps 303 and/or 304 until the feedback indicates that adequate shaving has been achieved for all areas of the body region. At that time, the user may stop shaving when shaving is indicated as complete, step 305.

Figure 5:
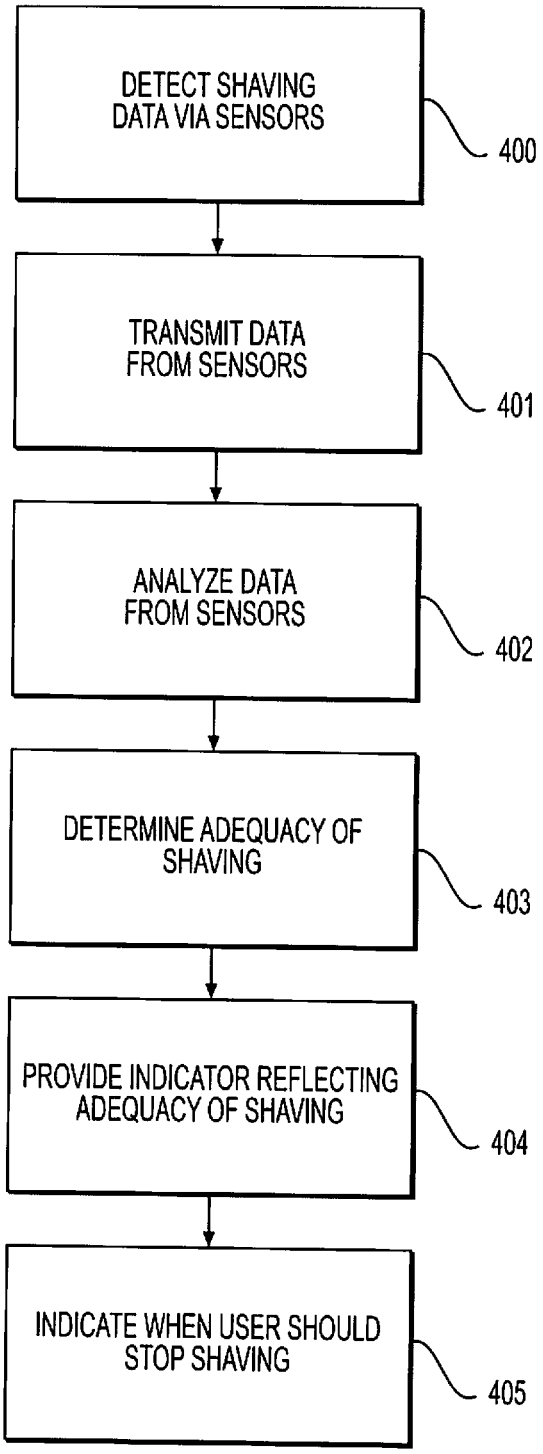
FIG. 5 is a flow chart portraying another exemplary shaving method, according to various embodiments of the present disclosure.

During the shaving process, the shaving system may perform the steps depicted in FIG. 5. As a user begins shaving, sensors on shaver 100 may begin detecting data, step 400. This data may be transmitted from sensors 20 on shaver 100 to a processor for analysis. The processor may be located on shaver 100, a separate base, a smartphone, a computer, or any other suitable component. The processor may have software loaded onto it configured to analyze data from the sensors, step 402. The processor may also be configured to analyze data stored in a database, which may include information from the user profile, including previously or simultaneously acquired images of the user's body region. Based on the analysis, the processor may determine the adequacy of shaving, step 403. An indicator may then be activated to indicate to a user the adequacy of the user's shaving, step 404. The indicator may be visual, auditory, or tactile, for example. The indicator may provide information about whether the user should continue or discontinue shaving in a certain area of the body region.

Eventually, the indicator may indicate that the user should stop shaving, step 405. It is contemplated that steps 404 and 405 may be combined so that an indicator is only provided once the analyzed data indicates that a user should stop shaving completely, and not prior to then. Or, as is shown in FIG. 5, indicators may be provided to communicate to a user shaving instructions to guide the shaving process and/or to indicate what amount or percentage of shaving remains to be done or has been completed, and/or what regions still need to be shaved.

Figure 6:
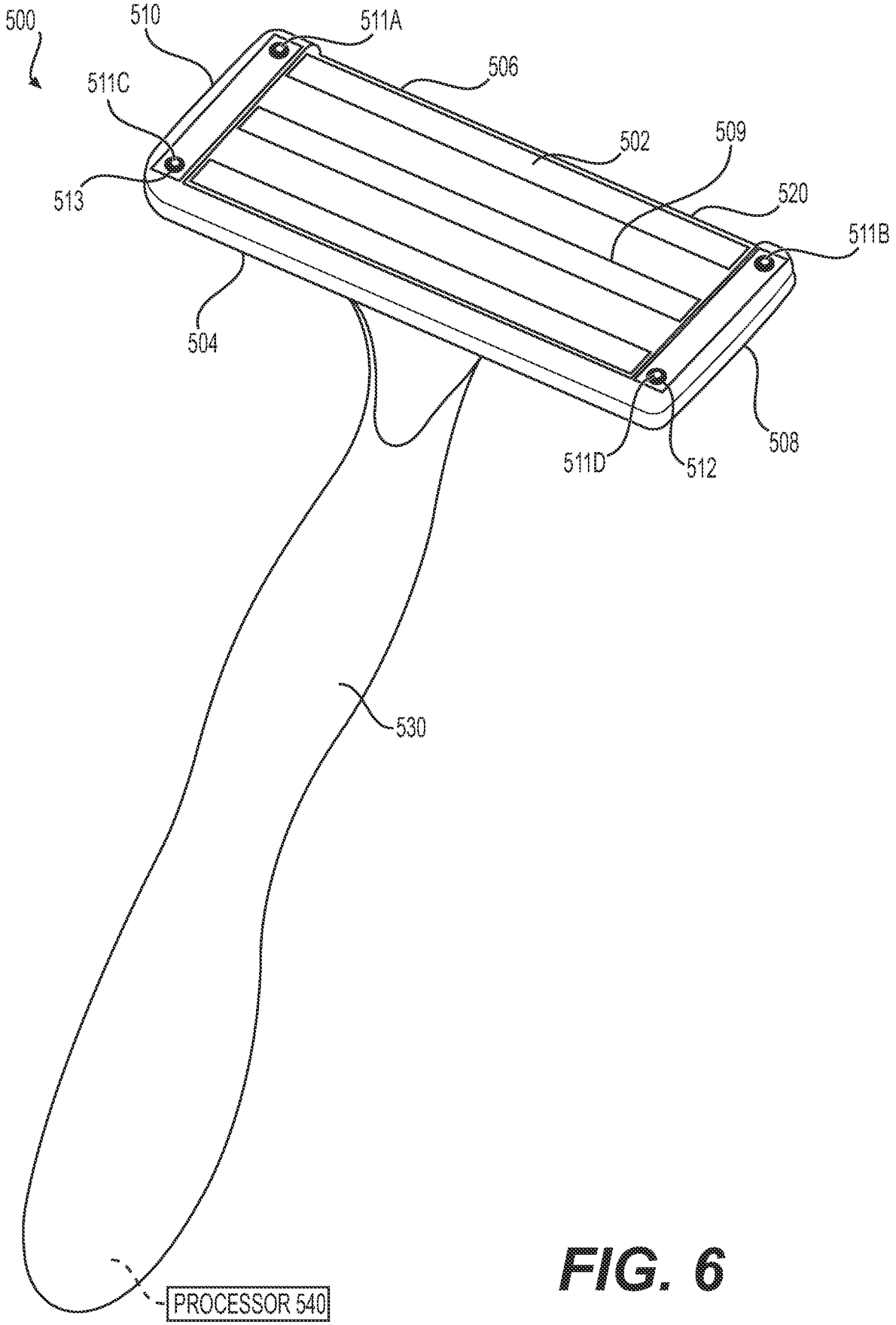
FIG. 6 shows an exemplary shaver, according to various embodiments of the present disclosure.
Figure 7:
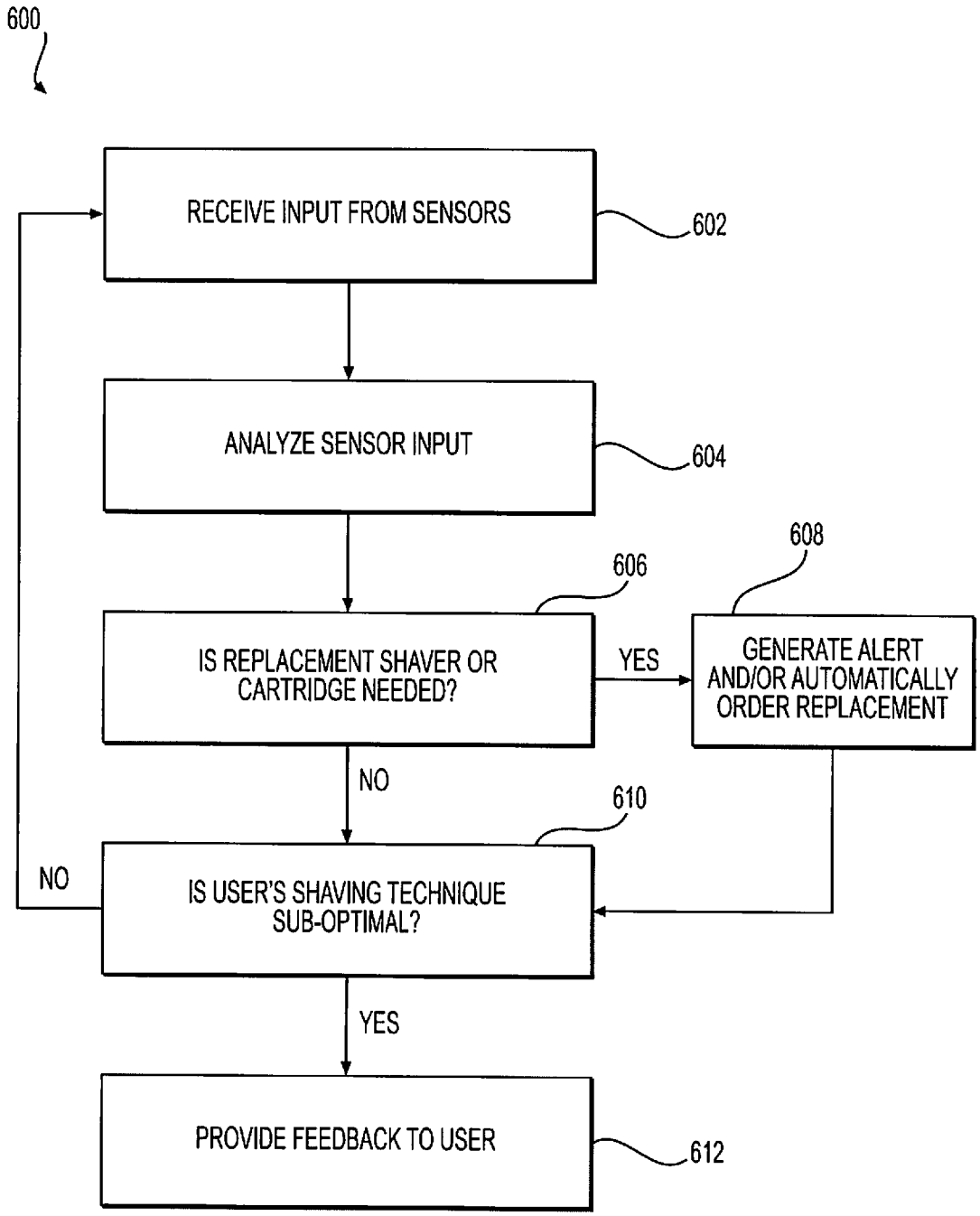
FIG. 7 is a flow diagram of an exemplary method, according to various embodiments of the present disclosure.

FIGS. 6 and 7 depict additional embodiments of the disclosure. FIG. 6 depicts an exemplary shaver 500 with sensors for providing feedback. Like shaver 100, shaver 500 includes a handle 530 and a cartridge 520 having one or more blades 509. Shaver 500 may also include at least one sensor 511 (FIG. 6 shows shaver 500 with four sensors 511*a-d*). Each sensor 511 may be configured to track a movement of shaver 511 and/or a force applied against cartridge 520.

For example, each sensor 511 may include a ball 512 that is rotatable (in any direction) within a socket 513. Ball 512 may also be configured to move laterally within socket 513 and retract into and out of socket 513, as will be described in greater detail below. Rotation, lateral movement, and/or retraction of ball 512 relative to socket 513 may be configured to trigger one or more additional sensors to, e.g., track movement and use of shaver 500. For example, rotation of ball 512 within socket 513 may be used to determine a shaving distance and/or speed of shaver 500 during a shave stroke. In another example, the start/stop of rotation of ball 512 within socket 513 may be used to define a stroke duration and may also be used to count the number of strokes taken during a shave session.

Sensors 511 may operate on a substantially similar principle as trackballs and roller mice used to control computer pointers. For example, each sensor 511 may be configured to use rollers or wheels to record the movement (rotation) of ball 512 within socket 513. Friction of the ball against these surfaces may turn small drive wheels, which sensor 511 records as movement on X and/or Y axes. The wheels may have small wire contact discs that pulse on and off signals as the wheel is rotated. A processor 540 then may translate the pulses in the signal as a movement of shaver 500. Processor 540 may be operably coupled to shaver 500. In one embodiment, processor 540 may be disposed remotely from shaver 500. In such instances, shaver 500 may include electronics to transmit and receive data to and from processor 540. In other embodiments, processor 540 may be disposed within shaver 500, e.g., within handle 530 and/or cartridge 520. In one alternative embodiment, the contacting discs may be replaced with a wheel marked with holes. LED light may be displayed through the holes, and read by an optical sensor. As light passes through the holes to the sensor or is interrupted by the spinning wheel, a pulse may be created that is translated into a recordation of the movement of shaver 500.

In some embodiments, a core of ball 512 may include metal, a metal alloy, or a plastic material, and the outer surface of ball 512 may be covered with a material (e.g., a rubber or other polymeric coating) having enough friction to grip the skin surface. Additionally, or alternatively, ball 512 may also include a lubricious coating to ensure user comfort. In other embodiments, an entirety of ball 512 (e.g., core and outer surface) may be formed from rubber or another material that exhibits a similar friction on skin. Ball 512 may have any suitable diameter including, for example, from about 0.1 mm to about 5.0 mm, from about 0.5 mm to about 4.5 mm, from about 1.0 mm to about 4.0 mm, from about 2.0 mm to about 3.0 mm, less than about 5.0 mm, less than about 2.5 mm, less than about 1.0 mm, greater than about 0.1 mm, greater than about 1.0 mm, or greater than about 2.5 mm, although other suitable ranges and values may also be utilized.

Sensors 511 may be integrated into any part of shaver 500. For example, sensors 511 may be in cartridge 520. In the embodiment shown in FIGS. 1 and 2, there are four sensors 511 (depicted as 511*a-d*). However, any suitable number of sensors may be utilized. For example, additional sensors may be positioned around the periphery of cartridge 520 to give a more robust understanding of the user's shaving habits. In one embodiment, cartridge 520 may include a grid of sensors 511 (e.g., a 4×4 grid, 8×8 grid, or the like).

Sensors 511 may be disposed on a skin-contacting surface of cartridge 520. In the embodiment shown in FIGS. 6 and 7, four sensors 511*a-d* are arranged in the corners of a skin-contacting surface 502 of cartridge 520. Skin-contacting surface 502 may be defined by a leading edge 504, a trailing edge 506, a first side 508, and a second side 510. Trailing edge 506 may be substantially parallel to leading edge 504, and trailing edge 506 may follow leading edge 504 during a shaving stroke. First side 508 may be substantially parallel to second side 510, and first side 508 and second side 510 each may be substantially perpendicular to each of leading edge 504 and trailing edge 506.

Sensors 511 may be self-cleaning in some embodiments. For example, one or more fluid conduits may be coupled to sockets 513 and may flush fluid through the sockets 513 to clear hair, shaving agents, and other contaminants from sockets 513 and balls 512. In other examples, sensors 511 may oriented such that placing cartridge 520 under running water, or submerging cartridge 520 in a volume of water is sufficient to clean sockets 513 and balls 512. In some examples, balls 512 may be removably coupled to motors, which, when activated by the user during a cleaning function, may rotate balls 512 to facilitate cleaning while cartridge 520 is held under running water or submerged, for example.

At some point, balls 512 may be unable to rotate due to the presence of hair or other obstructing objects in socket 513. Such inability to rotate may generate an error, e.g., an audio, visual, or haptic feedback from shaver 500, an associated base, or a mobile application associated with shaver 500. However, the inability of balls 512 to rotate may not deter or impede the ability of shaver 500 to continue to be used for normal shaving activities, albeit without fully functioning sensing capability.

In some embodiments, the movement of balls 512 may be used to indicate to processor 540 that shaver 500 is being used. Thus, sensors 511 can be used as a switch to "wake-up" other electronic systems of shaver 500. The use of sensors 511 as a switch may help conserve energy by ensuring that the electronic systems of shaver 100 are used only when needed, e.g., during a shaving session.

Shaver 500 may include a battery in handle 530 or cartridge 520 to power the various electronics of shaver 500. The battery may be charged by any suitable mechanism, including, e.g., an AC plug, a USB plug, inductive charging methods or the like. In other embodiments, the battery may be a replaceable disposable battery (e.g., a AAA battery). In yet another example, the battery may be charged via balls 512, which may act as charging contacts when in contact with corresponding electrical contacts in a base configured to receive cartridge 520.

In an alternative embodiment, sensor 511 may not include a ball, but may instead be an optical sensor. The optical sensor may utilize one or more LEDs and an imaging array of photodiodes to detect movement of cartridge 520 relative to the underlying skin surface.

In some embodiments, sensors 511 may also be configured to detect a force being applied against cartridge 520 via a load cell or piezoelectric sensor. For example, displacement of ball 512 within socket 513 may be indicative of normal and/or shear shaving forces by a load cell or piezoelectric sensor. It is also contemplated that additional sensors, separate from sensors 511, may be coupled to shaver 500 to detect forces applied against cartridge 520 (e.g., shear and normal forces).

As discussed above, shaver 500 may include or may be otherwise coupled to one or more processors 540. Data captured by sensors 511 may be stored in a memory and analyzed by processor(s) 540. In some embodiments, data from sensors 511 on shaver 500 may be transmitted to a separate base and/or to a smartphone or computer 550 by wired or wireless mechanisms. In some embodiments, information captured by scanning technology on a separate base may be transmitted to a smartphone or computer 550 or stored in memory on the base. In exemplary embodiments, data from sensors 511 may be transmitted to a base, a computer, or a smartphone having a processor 540 equipped with software configured to analyze the received data to provide information to the user pertaining to the user's shaving technique, a number of shaving strokes taken by the user (or distance shaver 500 has travelled or speed of shaver 500 during a shave stroke), and/or whether the user would benefit from one or more specialized items to optimize shaving performance and comfort. The processor and/or memory may be located on any component of the shaving system, for example, in shaver 500 itself, a base to which shaver 500 is docked, a smartphone, or a computer, and the components of the shaving system may transmit any stored or detected data to the processor for analysis.

As set forth above, processor 540 may determine a usage of shaver 500 based on the input received from sensors 511 over time. For example, processor 540 may track an overall distance travelled by shaver 500 and/or a number of shaving strokes that shaver 500 has been used for. For example, when processor 540 determines that shaver 500 has exceeded a usage threshold based on rotation of the one or more of balls 512 (which can be converted to a distance travelled of shaver 500), or based on a calculated number of shaving strokes taken, processor 540 may generate an alert and/or automatically order replacement parts such as, e.g., a replacement cartridge 520 or a replacement shaver 500.

Differences in the tracking data received from each of sensors 511*a-d* may help processor 540 analyze shaving strokes taken by the user. For example, over the course of a shaving stroke, the varying movements of the balls 512 disposed around cartridge 520 may help processor 540 determine that the user is applying too much force to one or more of leading edge 504, trailing edge 506, first side 508, and second side 510 while shaving. The uneven application of force may result in cuts, skin irritation, and/or excessive shaving strokes. Similarly, movement of balls 512 may help processor 540 determine that the user's shaving stroke includes a component of side-to-side movement (e.g., movement in a direction parallel to one or more blades 509 of the cartridge 500). Such side-to-side movements, or shave strokes including components of side-to-side movement, may result in nicks and/or cuts of the user's skin. In such instances, therefore, processor 540 may be configured to provide a notification or other feedback to the user to adjust the shave stroke or otherwise change a direction of movement of the shaver 500. Thus, processor 540 may alert the user of such abnormalities via the various feedback mechanisms described herein. For example, if processor 540 indicates that sensors 511*c* and 511*d* register a greater distance travelled than sensors 511*a* and 511*b*, processor 540 may inform the user of a bias in the user's shaving stroke toward leading edge 504. The processor 540 may evaluate the activation histories of the various sensors 511 to determine the skin/cartridge contact behavior observed in a given user's shaving technique.

Processor 540 may also analyze the data from sensors 511 to determine an efficiency of a shaving stroke, or of a shaving technique of the user. For example, processor 540 may analyze tracking data from sensors 511 to determine whether the user is taking an efficient or otherwise optimal path during the shaving stroke (or too curved or too straight), whether the shaving stroke is too long or too short, and/or whether the tempo of the stroke is appropriate. Thus, processor 540 may determine whether the user is incorporating undesirable pauses in his or her shaving stroke, and/or whether the shaving stroke is too quick or too slow. Processor 540 may also determine, based on force measurements, whether the user is applying too much or too little force at any portion of a stroke.

Various mechanisms may be used to notify a user of suboptimal shaving techniques and/or that shaver 500 is approaching an end of its recommended useful life. For example, a user may open an application on a computer or smartphone prior to commencement of shaving. As the user shaves, information about the shaving session may be generated and analyzed, and the results of the analysis may be displayed to the user via the application. For example, a picture of a face may appear on the application, and areas of the face may be indicated to the user as requiring more shaving or as being sufficiently shaved. Charts, text, colors, lights, pictures, or other suitable visual aids may indicate where the user does and does not need to shave, the percentage of shaving left or accomplished in a given area, or other suitable feedback, including, for example, whether the user is using shaving strokes that are too fast, too slow, whether the user is using too much or too little force during a shaving stroke, whether the user is using a suboptimal path during the shaving stroke, and/or whether the tempo of the user's shaving stroke can be improved. In some embodiments, the application may provide auditory or tactile feedback instead of, or in addition to, visual feedback. For example, a vibration or sound may indicate that a region of the body has been adequately shaved. In some embodiments, a voice may direct the user as to which portions of the user's face are becoming irritated.

In some embodiments, lights, noises, vibrations, and/or other visual, tactile, or auditory feedback may be provided on a separate base. For example, a light may go on when one or more blades 509 is too dull or when a user is utilizing poor technique, or a light may turn from green to red to indicate the same information. Or a screen on the base may show similar visual indicators as those described above in reference to the application, or a vibration or sound may be generated by the base as described above.

In some embodiments, the feedback described above may be incorporated into shaver 500. For example, shaver 500 may vibrate or emit a sound when, for example, shaver 500 is determined to be near an end of its useful life. In other examples, different colored LEDs can be used to convey such information. For example, a green LED may indicate that the shaver has between, e.g., 50 to 100 percent of its useful life remaining, a yellow LED may indicate that the shaver has between, e.g., 25 to 50 percent of its useful life remaining, and a red LED may indicate that the shaver has less than, e.g., 25 percent of its useful life remaining. It should be appreciated that other color schemes and percentages may also be used in various embodiments.

In this way, shaver 500 may provide a user with real-time feedback regarding shaving technique and the useful life remaining of shaver 500 or of a cartridge 520. This guidance and feedback may help to guide a shaving session to improve the user's shaving experience and to replace spent shaving equipment.

As indicated above, processor 540 may automate replacement ordering by contacting a merchant unit (not shown), or may provide a prompt to the user via display on a base or mobile phone associated with shaver 500 within a certain period of time. For example, as processor 540 determines that shaver 500 or cartridge 520 is approaching the end of its recommended useful life, processor 540 may place or prompt an order for a replacement shaver and/or replacement cartridge. The replacement or prompting may also be based on accumulated user information, such as, for example, how often the user shaves and how many strokes the user uses during a given shaving session. This user information may help processor 540 estimate when shaver 500 or cartridge 520 will reach the end of its recommended useful life, and order replacement parts so that they will arrive before shaver 500 or cartridge 520 reaches the end of its recommended useful life. The base or mobile application may also display or otherwise convey the accumulated user information.

The data collected by the various sensors described herein may be transmitted to a manufacturer of shavers 500 to be used for further study and analysis. In some embodiments, the user may need to grant the manufacturer permission to collect this data.

An exemplary method 600 is shown in FIG. 7. Those of ordinary skill in the art will recognize that one or more steps of method 600 may be performed out of the order depicted in FIG. 7 or eliminated altogether. Method 600 may begin at step 602, where processor 540 may receive input from sensors 511 while the user is shaving. The method then may proceed to step 604, where processor 540 may analyze the data from sensors 511. Based on the analyzed data, processor 540 may proceed to step 606 and determine whether a shaver 500 or cartridge 520 containing the sensors 511 is in need of replacement based on, e.g., a calculated distance travelled of shaver 500 or a number of shaving strokes taken by shaver 500 relative to a predetermined travel distance or shave strokes, respectively. If processor 540 determines that a replacement should be made, method 600 may proceed to step 608 where an alert may be generated and transmitted to the user, or where processor 540 may automatically initiate ordering of replacement parts. Method 600 may proceed to step 610 from step 608. Method 600 may also proceed to step 610 from step 606 if processor 540 determines at step 606 that replacement parts are not needed. At step 610, processor 540 may determine whether the user's shaving technique is suboptimal. If not, the method may return to step 602. If, however, there are one or more issues identified with the user's shaving technique, method 600 may proceed to step 612, where the user can be informed of such issues via the various feedback mechanisms disclosed herein.

FIGS. 8-13 depict another embodiment. FIGS. 8-13 illustrate a shaver 701, such as, e.g., a wet shaver, the blades of which are not driven by an electric motor. In other examples, however, the blades of shaver 701 may be driven, assisted, or vibrated by a motor. Shaver 701 may include a handle 702 and a shaving cartridge 703. In some examples, a portion or an entirety of shaving cartridge 703 may be driven, assisted, or vibrated by a motor. Shaving cartridge 703 may be a disposable shaving cartridge that includes one or several blades 704, and shaving cartridge 703 can be connected to and released from handle 702. Handle 702 may extend from a proximal end 705 to a distal end 706 along a longitudinal axis 710.

Shaving cartridge 703 may be configured to pivot and translate relative to handle 702. For example, a pusher 712 disposed at distal end 706 may allow shaving cartridge 703 to translate back and forth along longitudinal axis 710. Pusher 712 may include mating features that engage a corresponding guide 714 (e.g., a track, groove, or recess) in handle 702. Pusher 712 may be biased toward distal end 706 by a spring or other resilient member not shown. The distally directed bias of pusher 712 may bias shaving cartridge 703 into a rest position shown in FIG. 12. While shaver 701 is in use, pusher 712 may be subject to a proximally-directed force (e.g., from a face of the user), and may move proximally along the corresponding guide 714, with shaving cartridge 703.

Shaver 701 may include a switch 716 (shown in FIGS. 10-13) that may help track, among other things, such as for example, a number of shaving strokes taken with shaver 701, and other characteristics of use associated with shaver 701, including, but not limited to, length of a shaving session, an area of a body shaved, duration of a shave stroke, "tapping" of the shaver by the user when rinsing, and/or force applied to shaving cartridge 703 and, consequently, the skin shaved by a user.

Figure 11:
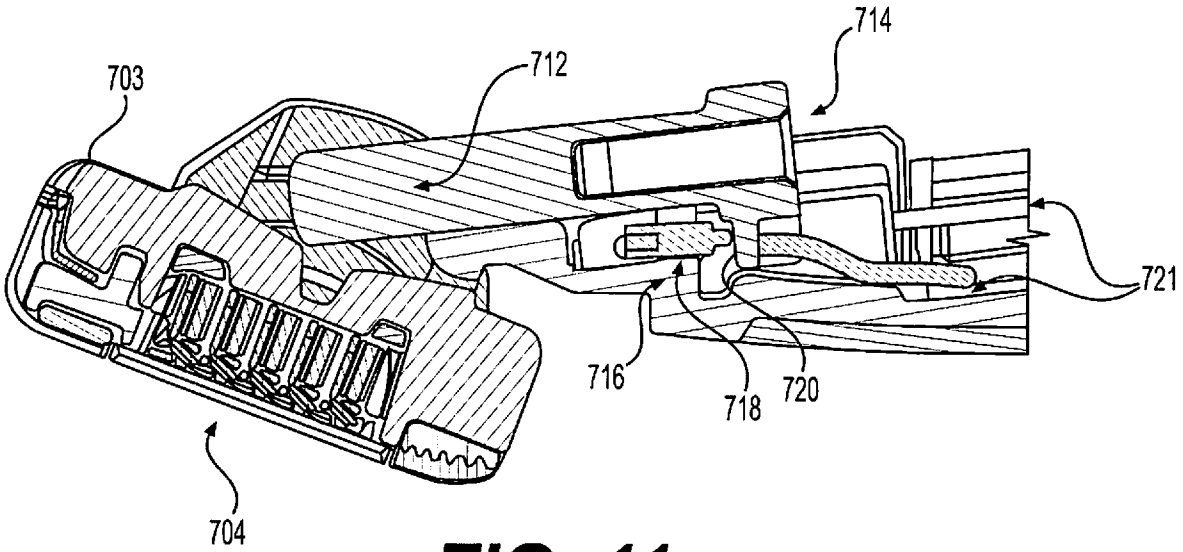
FIG. 11 is an enlargement of a portion of FIG. 10.
Figure 12:
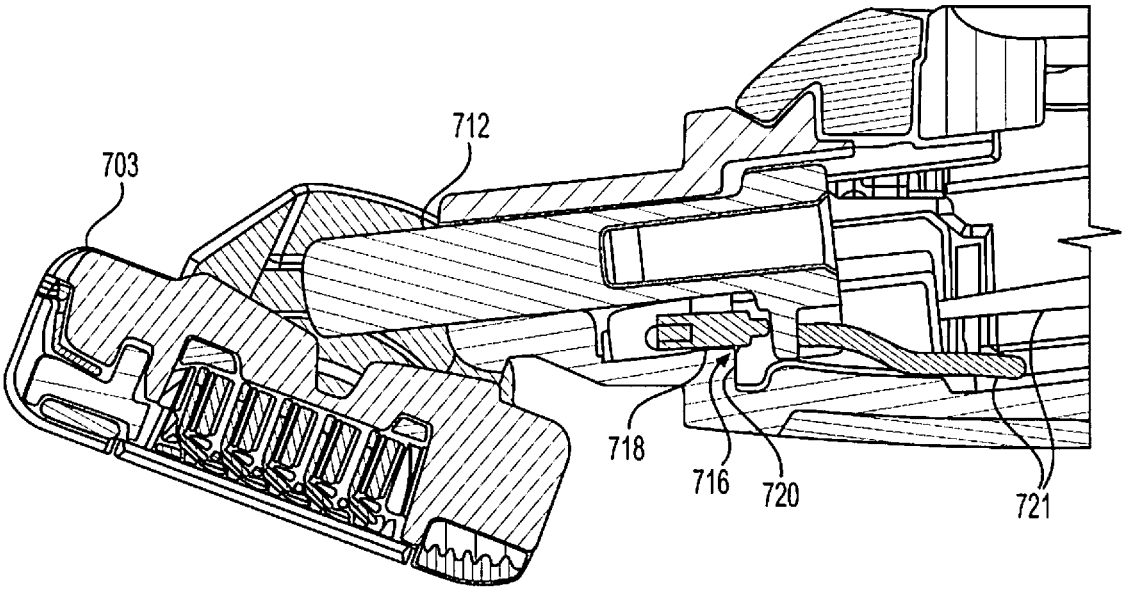
FIG. 12 is a side cross-sectional view of a portion of the shaver of FIG. 8 in a resting configuration.

With reference now to FIG. 11, for example, switch 716 may include a first electrical contact 718 (e.g., a conductive pin) and a second electrical contact 720. In one example, pusher 712 may be formed of a plastic or otherwise non-metal or non-conductive material. In this example, second electrical contact 720 may be a conductive material (e.g., a conductive pin) attached to the outer surface of, or extending from the non-conductive pusher 712. In another example, pusher 712 may be formed of metal or another conductive material, and pusher 712 itself may act as second electrical contact 720. In some embodiments, switch 716 may include a strain gauge associated with first electrical contact and/or second electrical contact 720. In such embodiments, switch 716 may also be configured to measure a force applied by first electrical contact 718 onto second electrical contact 720.

First electrical contact 718 may be fixed on or within handle 702 (by, e.g., a weld, adhesive, mechanical, or other suitable mechanism) at or adjacent distal end 706 of shaver 701. Second electrical contact 720 may be coupled (by, e.g., a weld, adhesive, mechanical, or other suitable mechanism) to a distally-facing portion of pusher 712 (e.g., a flange protruding radially outward or otherwise depending from a remainder of pusher 712). In the resting position of shaver 701, shown in FIG. 12, first electrical contact 718 and second electrical contact 720 may be in contact with one another to form a closed circuit configuration. While in use during a shaving stroke (e.g., a shaving position shown in FIG. 13), pusher element 712 may be proximal to the resting location shown in FIG. 12, facilitating separation of first electrical contact 718 and second electrical contact 720, resulting in an open circuit configuration of switch 716.

Figure 13:
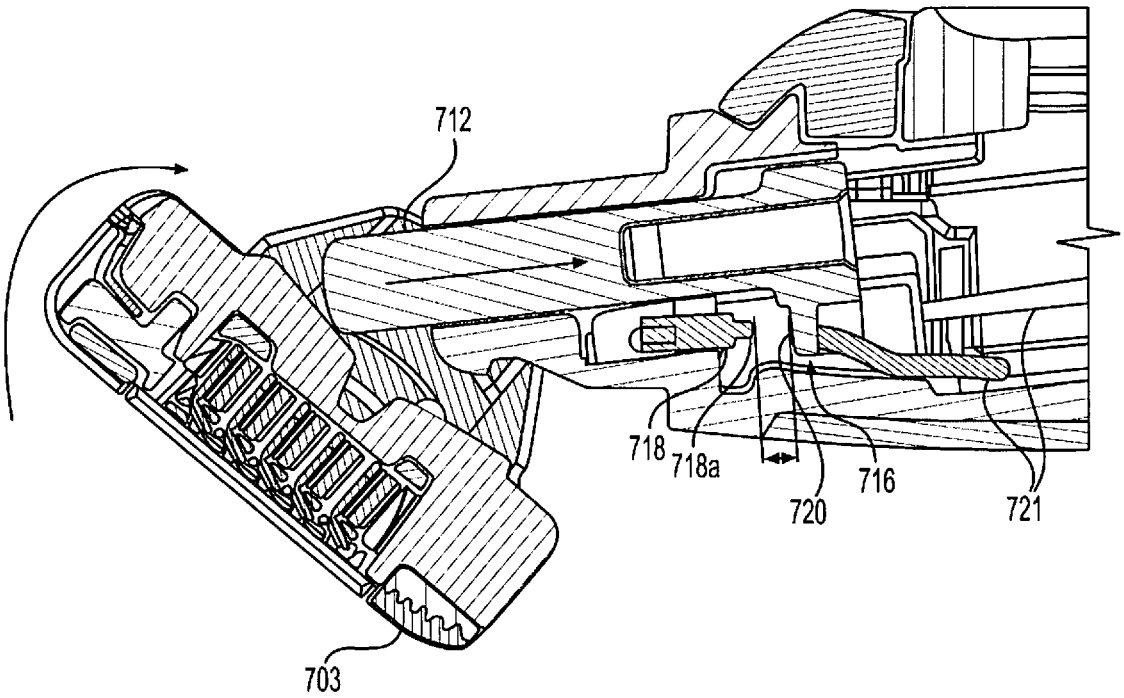
FIG. 13 is a side cross-sectional view of a portion of the shaver of FIG. 8 in a shaving configuration.

In an alternative example, the movement of pusher 712 toward proximal end 705 (e.g., by moving pusher 712 by the distance shown schematically by the double-sided arrows in FIG. 13) may move switch 716 from an open circuit configuration to a closed circuit configuration. In other words, in the alternative example, a switch 716 comprising two electrical contacts may be spaced apart from one another in the rest configuration, and the use of the shaver 701 in a shaving stroke may push the two electrical contacts 718, 720 into a closed circuit configuration, indicating a stroke of shaver 701. Switch 716 could also be on cartridge 703. For example, switch 716 may be a button or lever on the skin-contacting surface of cartridge 703.

Although only a single switch 716 is depicted and described herein, those of ordinary skill in the art will readily recognize that two or more switches 716 may be provided. For example, in some embodiments, two switches 716 may be provided on opposing sides of pusher 712. In such embodiments, shaver 701 may have built-in redundancy, should, for example, either one of the two switches 712 fail, thereby extending the longevity of handle 702. Moreover, in such embodiments, switches 716 may be configured to detect whether a user is evenly applying cartridge 703 to the skin being shaved. For example, if the cartridge is applied unevenly, only one of the two switches 716 may be closed, while the other switch 716 remains open.

With renewed reference to FIG. 13, first electrical contact 716 is depicted with a proximally-extending protrusion 718A. In some embodiments, for example those embodiments where switch 716 may be configured to make measurements of force (described in greater detail below), protrusion 718A may be configured to be telescopingly withdrawn into a remainder of first electrical contact 718, wherein a distance of withdrawal may correspond to a force applied by a user to cartridge 703.

Figure 17:
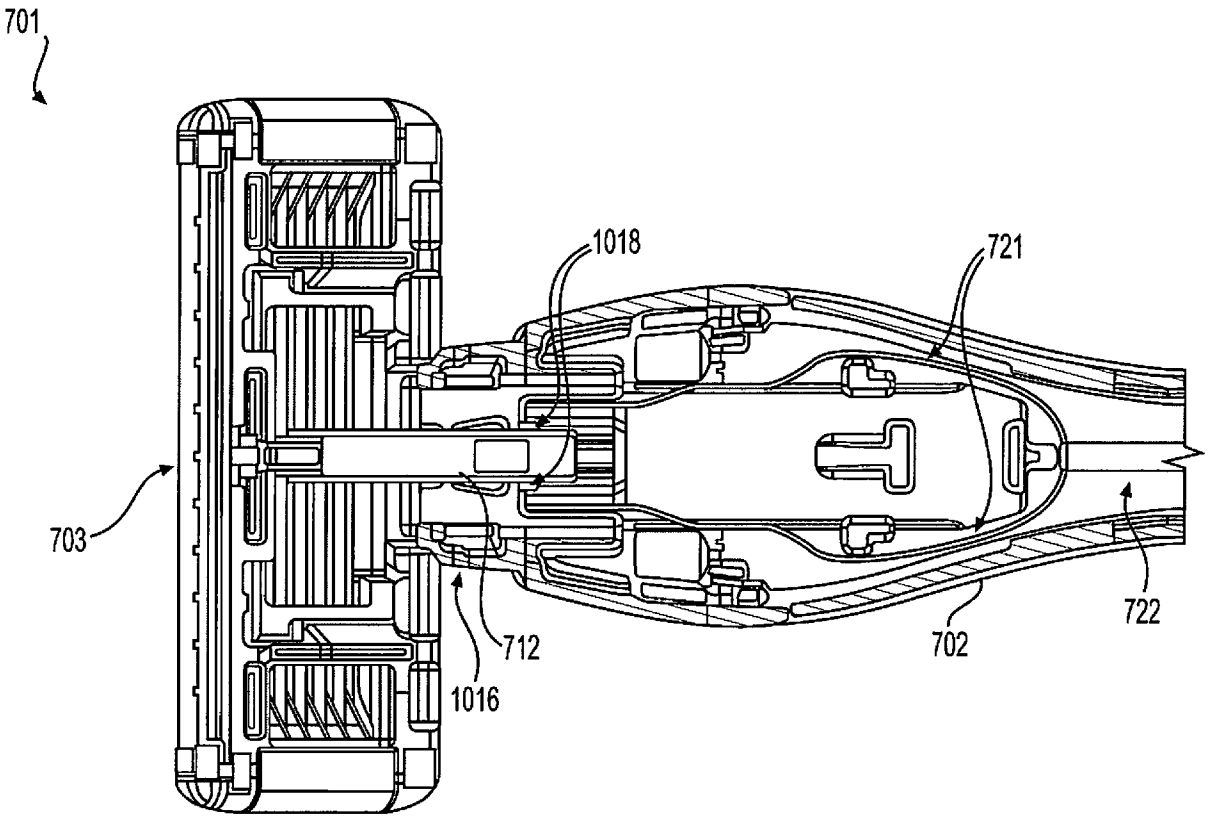
FIG. 17 is a top view of a shaver with a portion of the handle removed to show internal components of the shaver, according to another example of the present disclosure.
Figure 18:
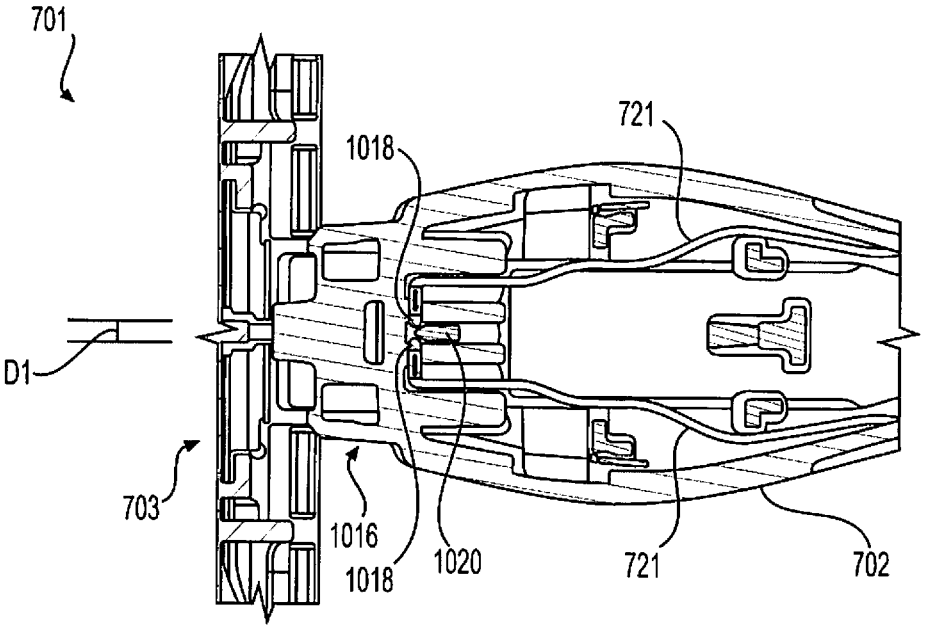
FIGS. 18 and 19 are top cross-sectional views of a shaver illustrating a switch, according to an example of the present disclosure.
Figure 19:
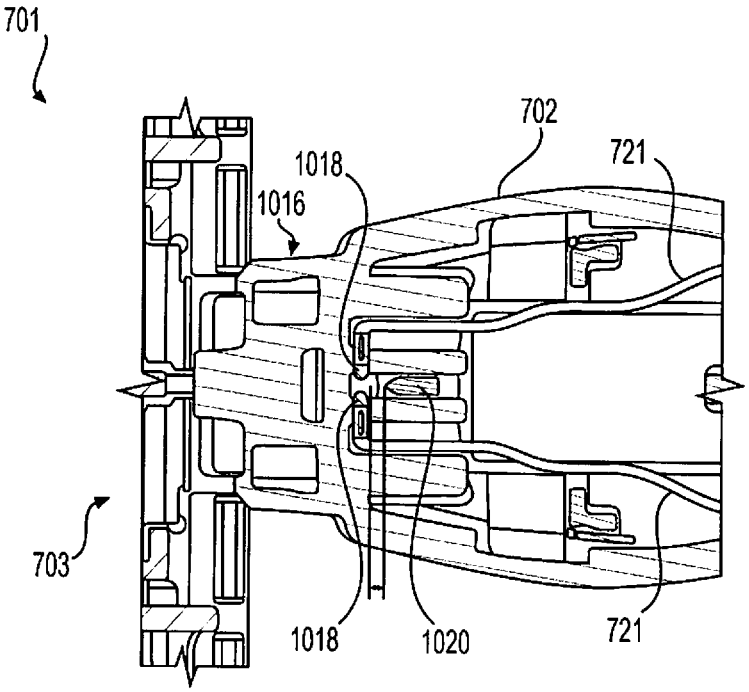

In FIGS. 17 and 18, for example, shaver 701 may include a handle 702, a cartridge 703, a pusher 712, and a printed circuit board (PCB) 722 as detailed below. In this example, a switch 1016 may include at least two first electrical contacts 1018 (e.g., conductive pins) that are separated from one another by a given distance D1. A second electrical contact 1020 (referring to FIG. 18) may be attached or otherwise secured to a plastic or otherwise non-mental or non-conductive pusher 712. Second electrical contact 1020 may be configured to reciprocally move with pusher 712. In addition, second electrical contact 1020 may have a maximum width spanning the distance of separation (i.e., distance D1) between first electrical contacts 1018. As shown in FIGS. 18 and 19, second electrical contact 1020 may include a substantially elongate configuration, wherein a distal end of second electrical contact 1020 may be configured to terminate in an apex. As a result, second electrical contact 1020 may be configured to electrically connect the two spaced apart first electrical contacts 1018 during a shave stroke (FIG. 18). That is, switch 1016 may be in an open circuit configuration when shaver 701 is in the resting position shown in FIG. 19, and may be in a closed circuit configuration when shaver 701 is moved to the shaving position (e.g., by being moved the distance shown schematically by the double-sided arrows in FIG. 19) shown in FIG. 18. As set forth above, the closed circuit configuration may indicate that, e.g., a shave stroke is being performed.

Figure 20:
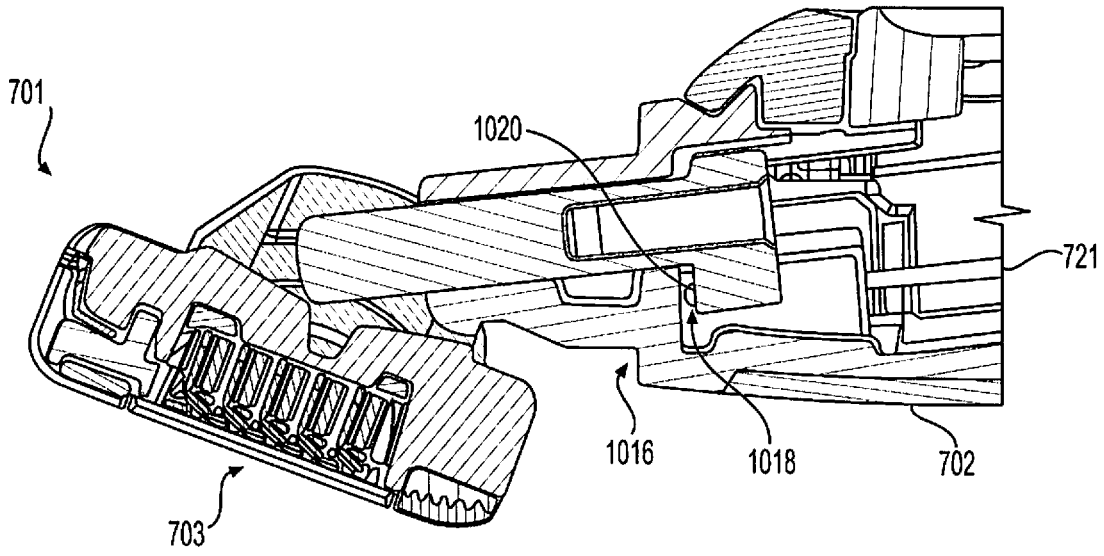
FIGS. 20 and 21 are side cross-sectional views of a shaver illustrating a switch, according to another example of the present disclosure.
Figure 21:
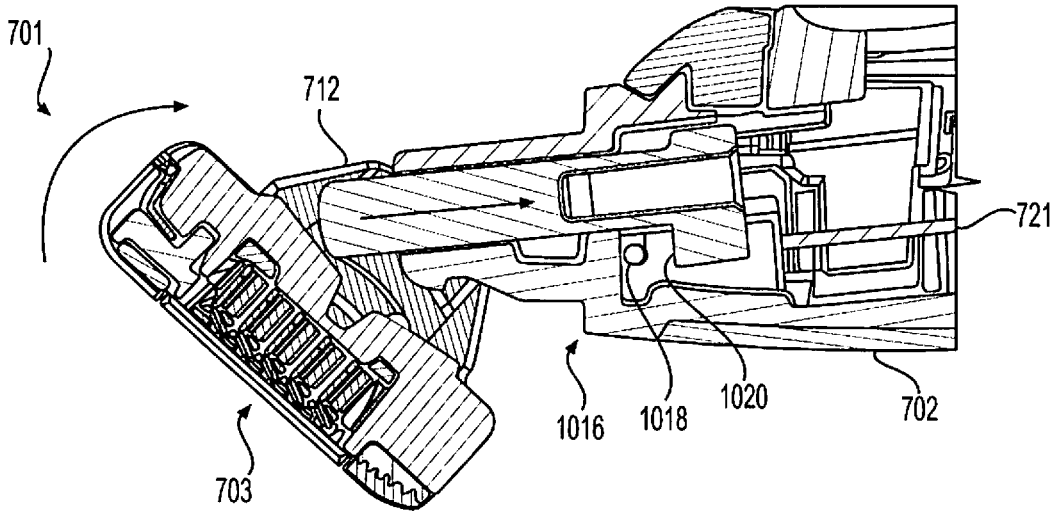

Turning now to FIGS. 20 and 21, another exemplary switch mechanism is detailed wherein pusher 712 is formed from metal or a conductive material. Thus, pusher 712 itself acts as second electrical contact 1020 to electrically connect first electrical contacts 1018 and close the circuit.

Figure 8:
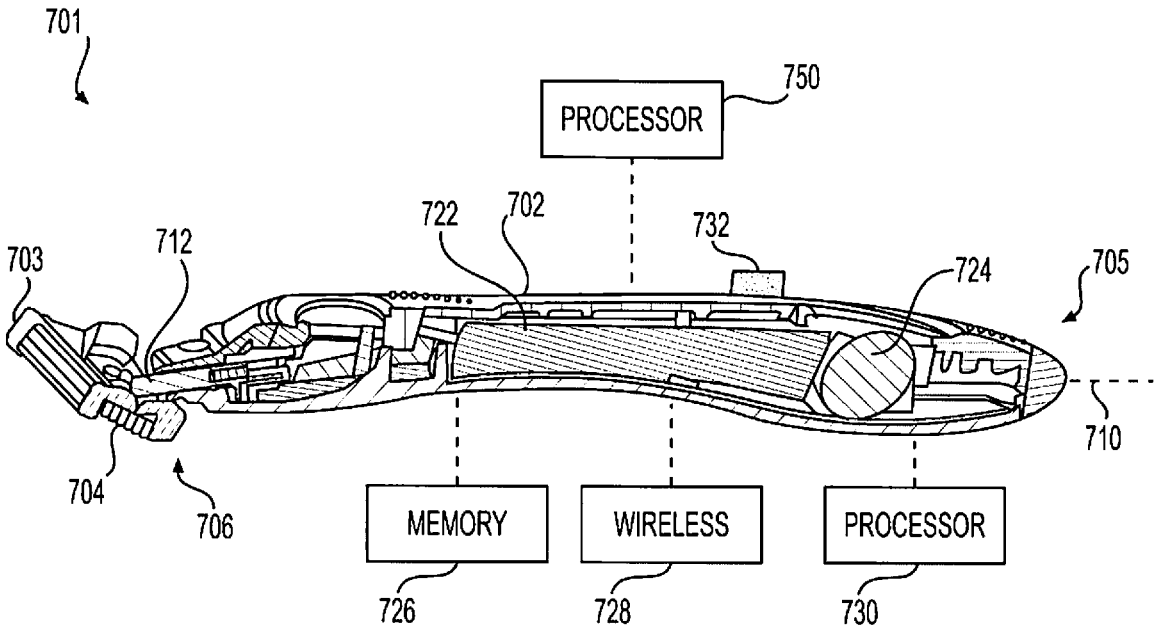
FIGS. 8 and 9 are perspective views of a shaver having a portion of a handle removed to show internal components of the shaver, according to an example of the present disclosure.
Figure 9:
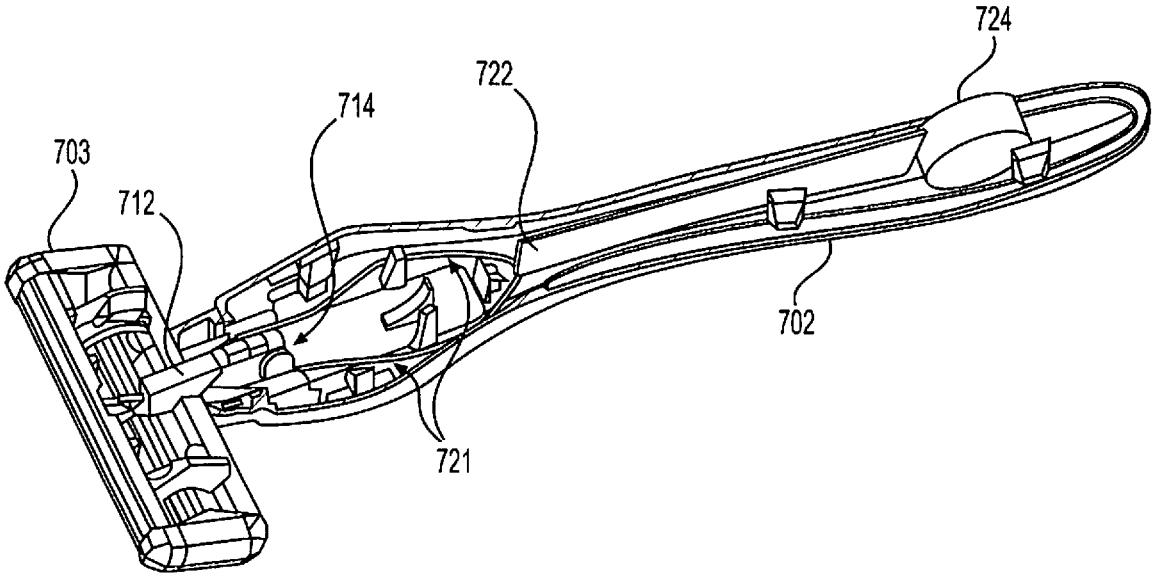
Figure 10:
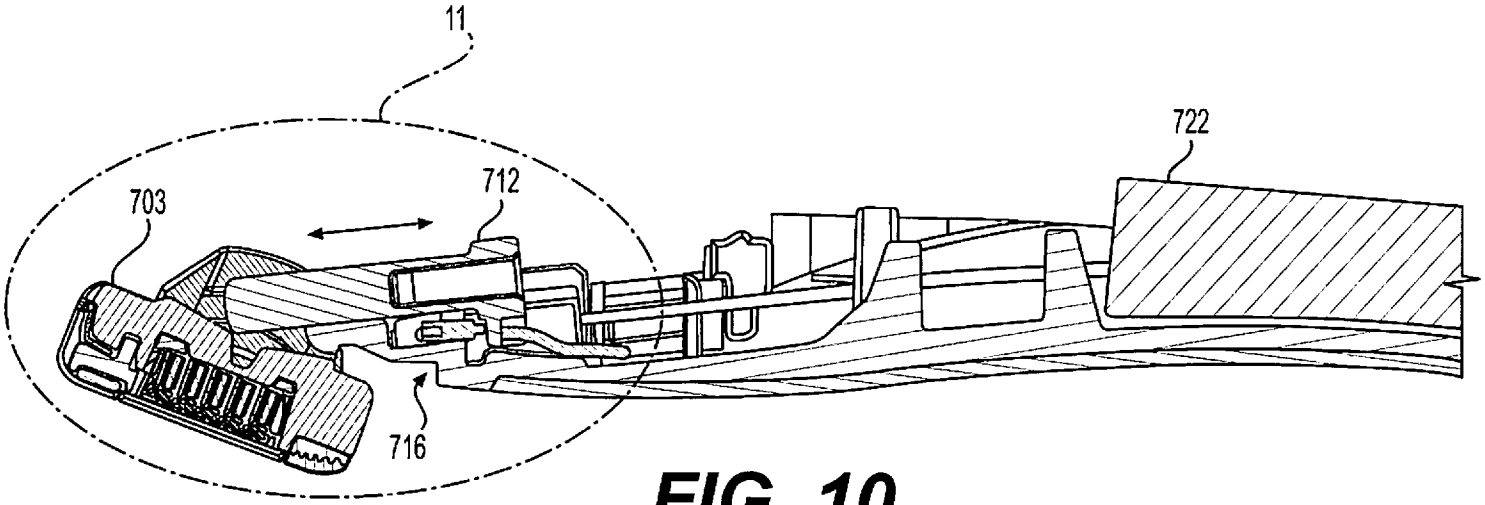
FIG. 10 is a side cross-sectional view of a portion of the shaver of FIG. 8.

In the example shown in FIGS. 17-21, the status of switch 1016 may be communicated (e.g., whether in the open circuit configuration or the closed circuit configuration) to memory 726 and/or processor 730 of PCB 722 via cables or wires 721 (shown in FIG. 8). Referring once again to FIGS. 8 and 9, shaver 701 may also include a printed circuit board (PCB) 722 within handle 702. Switch 716 may be coupled to PCB 722 via any suitable means, such as, but not limited to, for example cables or wires 721. PCB 722 may include a flexible printed circuit, or flex circuit, having a plurality of electronic devices mounted on a flexible plastic substrate, such as polyimide, PEEK or transparent conductive polyester film. In some instances, the flex circuits may be screen printed silver circuits on polyester or another suitable flexible substrate. PCB 722 may be coupled to a battery 724 (or other suitable power supply), and may also include a memory 726 (e.g., a flash memory) configured to record the status of switch 716 over time. Battery 724 may be charged by any suitable mechanism, including, e.g., an AC plug, a USB plug, inductive charging methods or the like. In other examples, the battery 724 may be a replaceable disposable battery (e.g., a coin cell or AAA battery). For example, handle 702 may be placed in a recharging base to inductively recharge battery 724. In another example, handle 702 may be operably coupled to a power source via wired charger.

In one example, memory 726 may be configured to store the status of switch 716 (e.g., whether switch 716 is in the closed circuit configuration or in the open circuit configuration) over time, and the respective durations associated with each occurrence of each configuration. In particular, memory 726 may store how often switch 716 is in the open configuration (indicating that a shaving stroke has been performed), and may also track a duration of time associated with each occurrence of switch 716 being in the open configuration (indicating a duration of the shaving stroke). Memory 726 may also store the frequency and duration of shaving strokes over the course of a shaving session, and/or over the course of multiple shaving sessions, to facilitate the identification of patterns in the shaving technique of the user. The information stored in memory 726 may be obtained via any suitable mechanism now known or later developed, including, but not limited to, a microprocessor 730 (described in greater detail below) or an application-specific integrated circuit (ASIC).

PCB 722 may also include a wireless communication module 728 that is configured to transmit information over one or more wireless modalities, such as, e.g., Bluetooth, Bluetooth low energy (BLE), infrared, cellular networks, and wireless networks, among others. In one example, wireless communication module 728 may transmit data stored in memory 726 to a processor 750. PCB 722 may also include a processor 730 coupled to an input device 732. Input device 732 may be positioned on an outer surface of handle 702, and may be, for example, a button configured to be pressed by a user of shaver 701. Although input device 732 is depicted as a button, in some embodiments, input device 732 may be a suitable sensor, such as, e.g., a fingerprint sensor or a thermal sensor configured to detect the presence of a hand or finger of the user.

Processor 750 may be operably coupled to shaver 701. In one example, processor 750 may be disposed remotely from shaver 701, such as for example, in a smart phone, smart device, computer, or other suitable electronic device, including, but not limited to, a charging base for handle 702. In other examples, processor 750 may be disposed within shaver 701, e.g., within handle 702 and/or cartridge 703.

Input device 732 may be configured to instruct processor 730 in handle 702 to run various firmware. For example, depressing input device 732 for a first threshold amount of time (e.g., two seconds), may initiate the controller 730, to pair wireless communication module 728 with a previously-associated device (e.g., a previously-synced Bluetooth-enabled phone). In other examples, depressing input device 732 for greater than a second threshold amount of time (e.g., greater than five seconds), may initiate the controller 730 setting wireless communication module 728 in a "discoverable mode" in which wireless communication module 728 may be paired to new devices, such as a previously-unsynced Bluetooth-enabled device.

In one example, the transition of switch 716 from the closed configuration to the open configuration (or vice versa in the alternative example) may be used to signify processor 730 that shaver 701 is being used. For example, in response to a threshold number of detected shaving strokes, processor 730 may initiate one or more of the pairing protocols discussed above, so that even when the user neglects to pair shaver 701 with a Bluetooth-enabled device via input device 732, such pairing may still be achieved. Thus, switch 716 may be used, in some examples, to "wake-up" other electronic systems of shaver 701 or of an accompanying electronic device. The use of switch 716 to activate other electronics systems may help conserve energy by ensuring that the electronic systems of shaver 701 are used only when needed, e.g., during a shaving session.

In some examples, shaver 701 may also be configured to detect a force being applied against cartridge 703 via a load cell or piezoelectric sensor. For example, displacement of pusher 712 may be indicative of normal and/or shear shaving forces by a load cell or piezoelectric sensor. It is also contemplated that additional sensors may be coupled to shaver 701 to detect forces applied against cartridge 703 (e.g., shear and normal forces).

As discussed above, shaver 701 may include or may be otherwise coupled to one or more processors 750. Data captured by switch 716/processor 730 and stored in memory 726 may be communicated to and analyzed by processor(s) 750. In some examples, data from memory 726 may be transmitted to a separate base and/or to a smartphone or computer 550 by wired or wireless mechanisms. In some examples, information captured by scanning technology on a separate base may be transmitted to a smartphone or computer 550 or stored in memory on the base. In some examples, data from switch 716 may be transmitted to a base, a computer, or a smartphone having a processor 750 equipped with software configured to analyze the received data to provide information to the user pertaining to the number of shaving strokes taken by the user, the shaving technique of the user, and/or whether the user would benefit from one or more specialized items to optimize shaving performance and comfort. The processor and/or memory may be located on any component of the shaving system, for example, in shaver 701 itself, a base to which shaver 701 is docked, a smartphone, or a computer, and the components of the shaving system may transmit any stored or detected data to the processor for analysis.

As set forth above, processor 750 may determine a usage of shaver 701 based on the input received from switch 716 over time. For example, processor 750 may track a number of shaving strokes that shaver 701 (and in particular cartridge 703) has been used. When processor 750 determines that shaver 701 has exceeded a usage threshold based on the number of times that switch 716 has transitioned from the closed circuit configuration to the open circuit configuration (e.g., based on a calculated number of shaving strokes taken), processor 750 may generate an alert and/or automatically order replacement parts such as, e.g., a replacement cartridge 703.

Various mechanisms may be used to notify a user of suboptimal shaving techniques and/or that shaver 701 is approaching an end of the recommended useful life. For example, a user may open an application on a computer or smartphone prior to commencement of shaving. As the user shaves, information about the shaving session may be generated and analyzed, and the results of the analysis may be displayed to the user via the application. Charts, text, colors, lights, pictures, or other suitable visual aids may indicate whether the user is using shaving strokes that are too fast or too slow, and/or whether the tempo of the shaving stroke of the user may be improved. In some examples, the application may provide auditory or tactile feedback instead of, or in addition to, visual feedback. Also, in examples where shaver 701 is connected with a smart device (e.g., smartphone, tablet etc.), the smart device may be configured to acquire an image of the skin of the user in order to facilitate determining various characteristics (e.g., hair density), and in conjunction with the stroke data (number and length of strokes), propose a different shaving cartridge 703 and/or different shaving regime to the user. The acquired image may be either locally processed on the smart device, or transmitted to a remote processor, and suitable algorithms may be employed to extract information from the acquired image.

In some examples, lights, noises, vibrations, and/or other visual, tactile, or auditory feedback may be provided on a separate base. For example, a light may be illuminated when one or more blades 704 is too dull or when a user is utilizing poor technique, or a light may turn from green to red to indicate the same information. Additionally, a screen on the base may show similar visual indicators, or a vibration or sound may be generated by the base.

In some examples, the feedback described above may be incorporated into shaver 701. For example, shaver 701 may vibrate or emit a sound when it is determined that cartridge 703 may be near an end of its useful life. In other examples, different colored LEDs may be used to convey such information. For instance, a green LED may indicate that the cartridge 703 has between, e.g., 50 to 100 percent of its useful life remaining, a yellow LED may indicate that the cartridge 703 has between, e.g., 25 to 50 percent of its useful life remaining, and a red LED may indicate that the cartridge 703 has less than, e.g., 25 percent of its useful life remaining. It should be appreciated that other color schemes and percentages may also be used in various examples. In some examples, such LEDs, or other visual feedback mechanisms, may be provided on or incorporated within handle 702.

Shaver 701 may provide a user with real-time feedback regarding shaving technique and the useful life remaining of shaver 701 or of a cartridge 703. This real-time feedback may help to guide a shaving session to improve the shaving experience and to replace spent shaving equipment.

As indicated above, processor 750 may automate replacement ordering by contacting a merchant unit (not shown), or may provide a prompt to the user via display on a base or mobile phone associated with shaver 701 within a certain period of time. For example, as processor 750 determines that shaver 701 or cartridge 703 is approaching the end of its recommended useful life, processor 750 may place or prompt an order for a replacement shaver and/or replacement cartridge. The replacement or prompting may also be based on accumulated user information, such as, for example, how often the user shaves and how many strokes the user uses during a given shaving session. This user information may assist processor 750 in estimating when shaver 701 or cartridge 703 will reach the end of its recommended useful life, and order replacement parts for arrival at a user designated location and immediate availability to the user before shaver 701 or cartridge 703 reaches the end of its recommended useful life. The base or mobile application may also display or otherwise convey the accumulated user information. The aforementioned user information may also be used to provide recommendations to the user to, e.g., realize cost efficiencies by switching to another kind of cartridge 703 (e.g., with 702 blades instead of 704), without sacrificing shave quality or comfort, as described in greater detail below.

The data collected by the various sensors described herein may be transmitted to a manufacturer of shaver 701 to be used for further study and analysis. In some examples, the user may need to grant the manufacturer permission to collect this data.

Processor 750 may also be configured to prepare a recommendation for the user to purchase and use a different cartridge 703 than the cartridge 703 used to collect the shave stroke data. For example, processor 750 may be configured to recommend that the user purchase a cartridge 703 having more or fewer blades 704 based on the collected shave stroke data and based on the type of cartridge 703 used to collect the shave stroke data.

Processor 750 may also analyze the data from switch 716 to determine whether the shaving stroke of the user is too long or too short, and/or whether the tempo of the stroke is appropriate. Thus, processor 750 may determine whether the user is incorporating undesirable pauses in his or her shaving stroke, and/or whether the shaving stroke is too fast or too slow. As alluded to above, processor 750 may also be configured to determine a shaving force applied by the user, and whether the cartridge 703 is moved across the body portion of the user in an even, flat manner.

Figure 14:
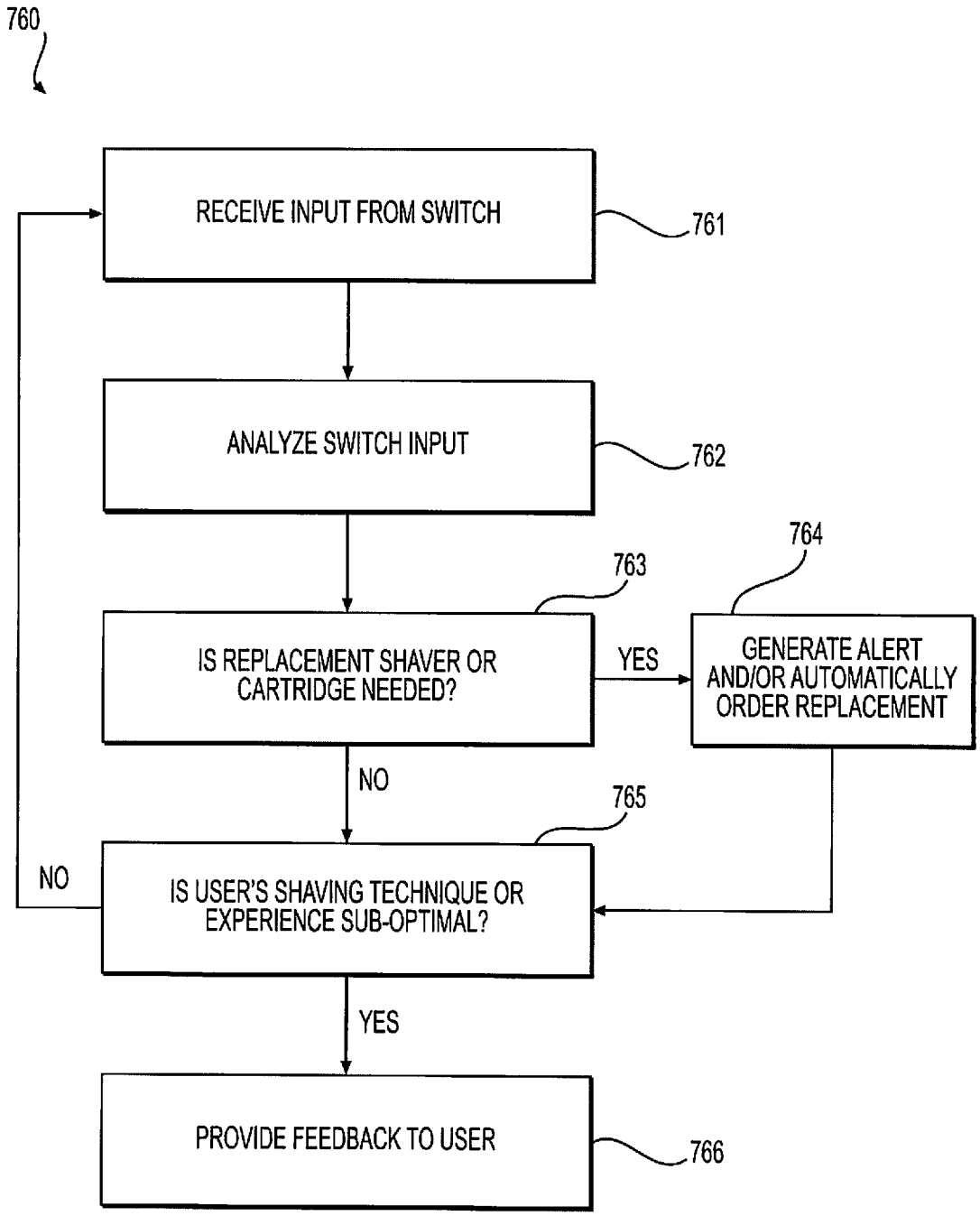
FIGS. 14-16 are flowcharts of exemplary methods of the present disclosure.

An exemplary method 760 is shown in FIG. 14. Those of ordinary skill in the art will recognize that one or more steps of method 760 may be performed out of the order depicted in FIG. 14 or eliminated altogether. Method 760 may begin at step 761, where processor 730 or 750 may receive input from switch 716 while the user is shaving. The method may then proceed to step 762, where processor 730 or 750 may analyze the data from switch 716. Based on the analyzed data, processor 730 or 750 may proceed to step 763 and determine whether a shaver 701 or cartridge 703 needs replacement based on, e.g., a number of shaving strokes taken by shaver 701 relative to a predetermined number of shave strokes. If processor 730 or 750 determines that a replacement should be made, method 760 may proceed to step 764 where an alert may be generated and transmitted to the user, or where processor 750 may automatically initiate ordering of replacement parts. Method 760 may proceed to step 765 from step 764. Method 760 may also proceed to step 765 from step 763 if processor 730 or 750 determines at step 763 that replacement parts are not needed. At step 765, processor 730 or 750 may determine whether the user shaving technique or experience is suboptimal. For example, the user shave experience may be suboptimal if portions of the shaver 701 being used may be more expensive when relatively more inexpensive options may exist. If not, the method may return to step 761. If, however, there may be one or more issues identified with the shaving technique of the user, method 760 may proceed to step 766, where the user may be informed of such issues via the various feedback mechanisms disclosed herein.

Figure 15:
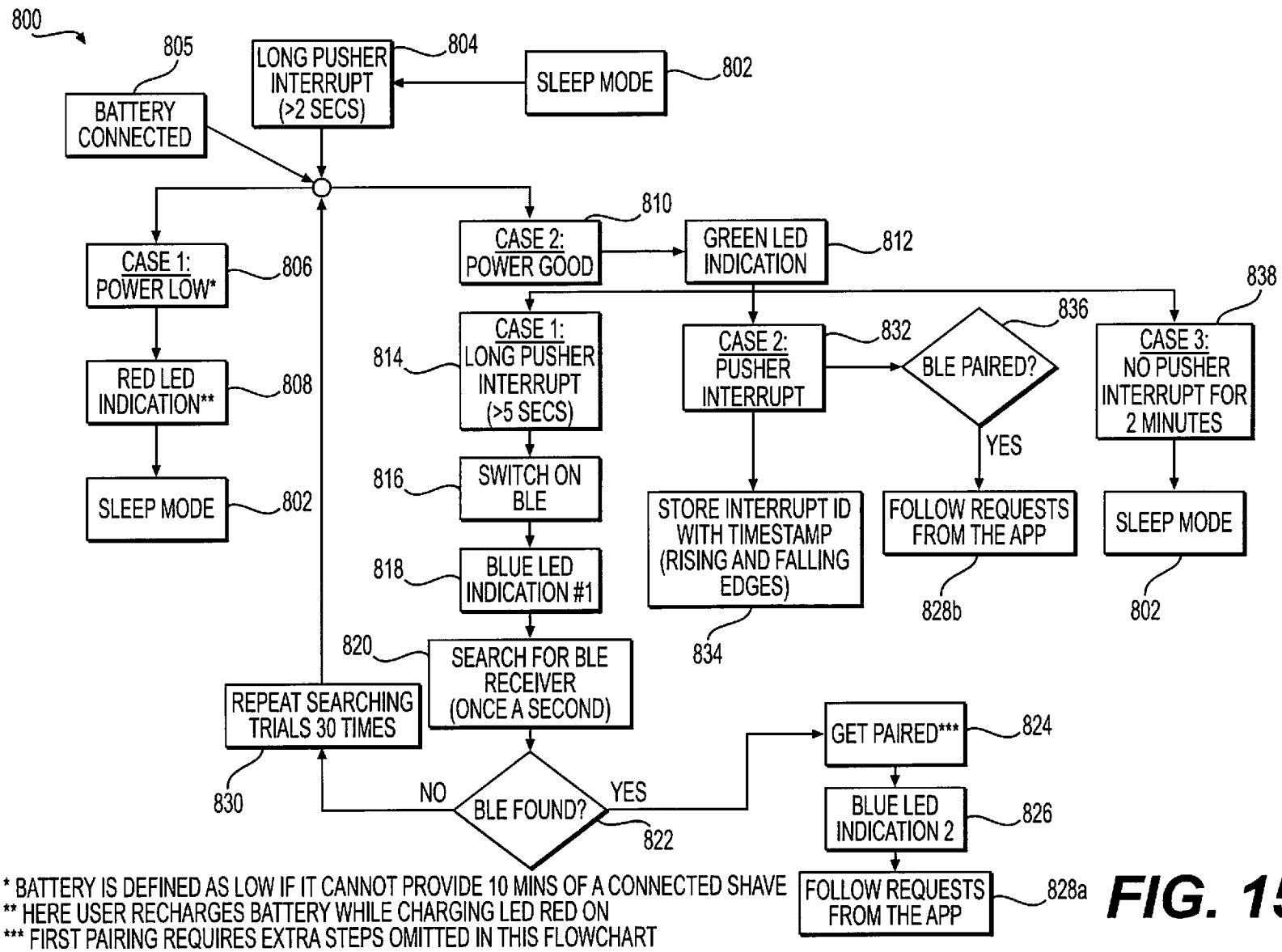

A method 800 is shown in FIG. 15, which illustrates various firmware protocols configured to be run by processor 730 within handle 702. Method 800 may begin at step 802, when shaver 701 is in a "sleep mode," configured to conserve power. Method 800 may proceed to step 804, where processor 730 may determine whether input device 732 has been depressed for greater than a first threshold period of time, e.g., two seconds, or if switch 716 is placed in the open configuration for greater than a predetermined threshold of time, e.g., two seconds. If processor 730 determines that input device 732 has been depressed for greater than the first threshold period of time, or that switch 716 is placed in the open configuration for greater than a predetermined threshold of time, method 800 may proceed to step 805, where a connection to battery 724 or a power level of battery 724 may be determined. If battery 724 is determined to have a relatively low power level (step 806), or to be disconnected altogether, method 800 may proceed to step 808 where a RED LED, or other low-battery indication, is activated, and back to step 802 to enable processor 730 to enter the sleep mode. In some examples, battery 724 may be defined as having a low power level if processor 730 determines that battery 724 cannot provide, for example, at least 10 minutes of connectivity to processor 750 via wireless communication module 728.

If, however, at step 805, processor 730 determines that battery 724 has a sufficient power level to proceed with, e.g., a shaving session (step 810), method 800 may proceed to step 812, where a GREEN LED, or other indication indicating a sufficient battery level, is activated.

Once processor 730 has determined that battery 724 has sufficient power to proceed with a shaving session (step 812), method 800 may proceed in any one of three potential paths, identified as Case 1, Case 2, and Case 3 in FIG. 15.

Case 1 (step 814) may result when switch 716 is opened (e.g., a relatively long pusher interrupt) for an extended period for time such as, e.g., greater than five seconds. A relatively long pusher interrupt may be caused when a user first begins to shave via a long shave stroke. Alternatively, the relatively long pusher interrupt may result from the user pressing cartridge 703 against skin to be shaved, or on the palm of the user to, "wake up", for example, the electronics within shaver 701. In an alternative embodiment, case 1 (step 814) may result from the user activating input device 732 for greater than a second threshold period of time that is greater than the first threshold period of time. The second threshold period of time may be five seconds in one example, or may be another suitable time period. Instead of a second threshold period of time, processor 730 may respond to different commands at step 814, such as, for example multiple quick and successive activations of input device 732, or switch 716 opening and closing multiple times and/or rapidly in a short amount of time. If processor 730 makes a positive determination at step 814, method 800 may proceed to step 816, where wireless communication module 728 (e.g., a Bluetooth Low Energy transmitter) may be activated, and to step 818 where a first BLUE LED indication may be activated to indicate that wireless communication module 728 is in a "discoverable" mode. At a step 820, wireless communication module 728 may search for a compatible receiver, such as, e.g., a Bluetooth Low Energy receiver on the device housing or within handle 702. The search may be performed at a rate of once per second, for example, or any other suitable rate. If at step 822, a compatible device is found, method 800 may proceed to step 824, where shaver 701 and the compatible device are paired to one another. A second BLUE LED indication (e.g., multiple blinking lights) may be activated at step 826 to indicate the successful pairing. Then, method 800 may proceed to step 828*a*, where processor 730 may follow instructions provided via an application run by processor 750. If, however, no compatible device is found at step 822, method 800 instead may proceed to step 830, where a suitable number of attempts, for example, 30 attempts within a predetermined period of time, are made to find a compatible device. If, after the prescribed number of attempts, no compatible device is found, method 800 may proceed to step 802 and processor 730 may enter the sleep mode.

Method 800 may proceed according to Case 2 if processor 730 detects switch 716 being opened one more times, wherein the duration of each opening is shorter than the "long pusher interrupt" described above in connection with Case 1. For example, if at step 832, processor 730 determines that switch 716 is opened for a time period less than, for example five seconds, before it is closed, method 800 may proceed to step 834 to begin storing data relating to each time switch 716 is opened and the duration of the open. In some instances, the data may include a date and/or time stamp associated with each open and each close (i.e., the rising and falling edges of a signal associated with actuation of switch 716). In addition, or alternatively, method 800 may proceed to step 836 where processor 730 determines if shaver 701 is paired with a suitable wireless communication module (e.g., Bluetooth Low Energy). If processor 730 determines that a suitable pairing exists, method 800 proceeds to step 828*b*, where processor 730 may follow instructions provided to it via an application run by processor 750.

If processor 730 fails to detect any change in state of switch 716, i.e., switch 716 remains open or closed, for a predetermined time period longer than the time period described above in connection with Case 1, such as, e.g., 1 minute, 2 minutes, or more, method 800 may proceed to place the electronics of shaver 701 in sleep mode, step 802.

Figure 16:
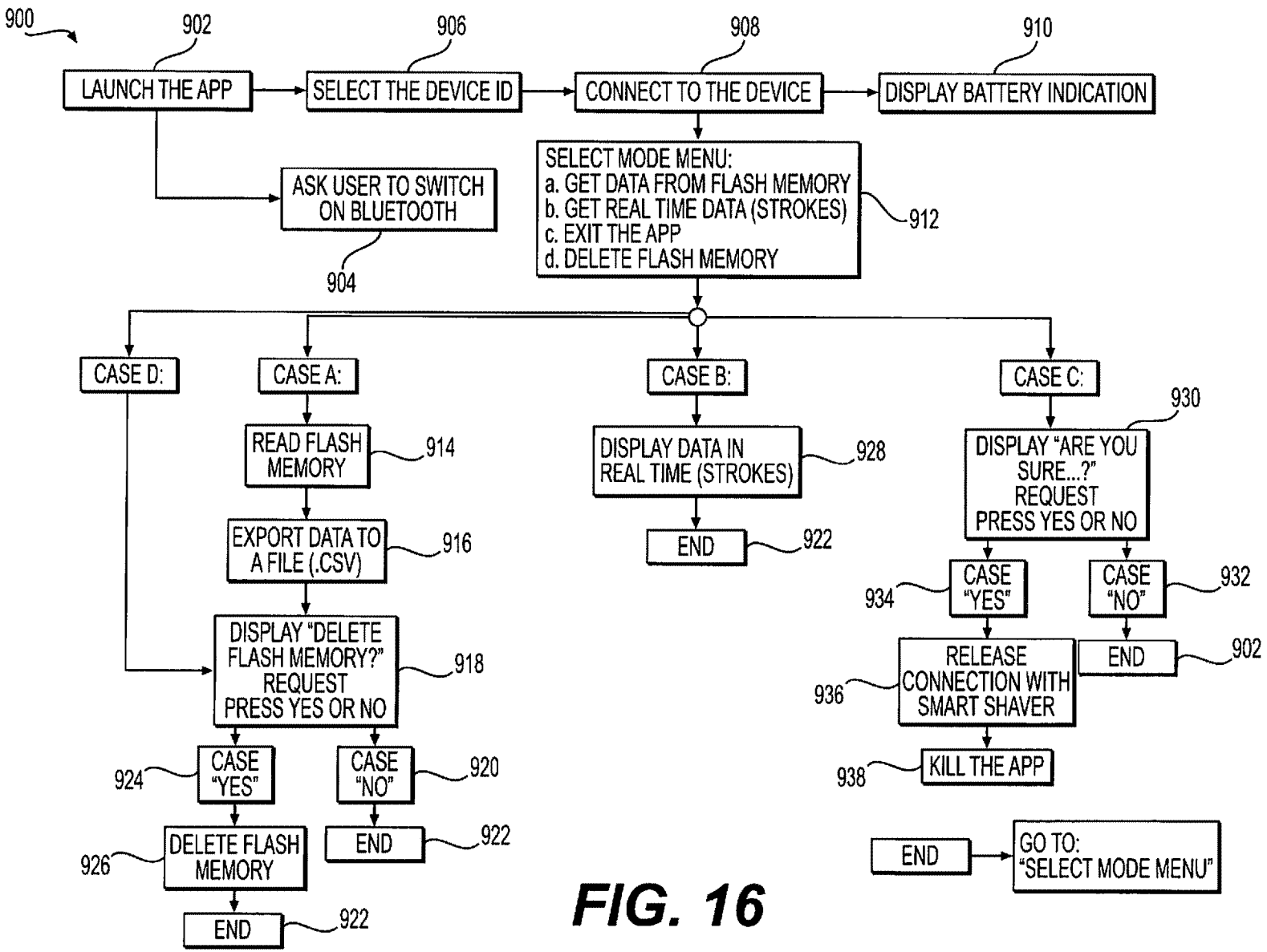

A method 900 is shown in FIG. 16, which illustrates various software protocols configured to be run by processor 750. Method 900 may begin at step 902, where a mobile application installed on, e.g., a smart phone, smart device, or a computer, may be initiated. The method may proceed to step 904, where the application may prompt a user to switch on Bluetooth or another wireless protocol on the device. In addition, or alternatively, method 900 may proceed to step 906, where a device ID may be selected. The method 900 then may proceed to step 908, where a connection between the device and shaver 701 may be made. From step 908, the method may proceed to step 910, where battery information may be displayed in the application, and/or to step 912, where a menu may be presented to a user. As shown in FIG. 16, the menu may include (a) "get data from flash memory", (b) "get real time data (strokes)", (c) "exit the app", and/or (d) "delete flash memory." If at step 912, the user selects "get data from flash memory," the method may proceed to step 914, where processor 750 may read memory 726 of shaver 701, and may initiate export of the stored data to a file (e.g., a .csv file) at step 916. Method 900 may proceed to step 918, where the user may be prompted to select whether or not to delete the flash memory. If at step 918, the user selects "No," at step 920, method 900 may proceed to step 922 and return to menu, step 912. If however, at step 918, the user selects "Yes," at step 924, method 900 may proceed to step 926 to erase memory 726. Method 900 then may be terminated by proceeding to "End," step 922, from step 926.

If at step 912, the user selects "get real time data (strokes)," method 900 may proceed to step 928, where real time stroke data, including, e.g., the number and length of shaving strokes taken, may be collected and displayed to the user via a screen of the smartphone, smart device, or computer. Method 900 then may be terminated by proceeding to "End," step 922, from step 928.

If at step 912, the user selects "exit the app," method 900 may proceed to step 930 to request confirmation of this action. If the user selects "No," at step 932, method 900 may be terminated by proceeding to "End," step 922. If the user confirms at step 934 that the application should be exited, the connection, e.g., Bluetooth connection, with shaver 701 may be severed at step 936, and the application may be closed at step 938. If at step 912, the user selects "delete flash memory," method 900 may proceed to step 918 described above. In each instance where method 900 is terminated by proceeding to step 922, the method 900 may return the user to menu described above in connection with step 912.

Examples of the present disclosure may help quantitatively and/or qualitatively track and analyze stroke habits and shaving techniques of users while shaving, without altering the outer shape of the shaver or adding extra components. Indeed, the pusher already may be an integral part of a shaver, and minimal alteration to the shaving mechanism or shaving experience is needed to collect stroke data. All, or substantially all of the necessary, electronics can be embedded within the shaver (e.g., handle 702) so there is no need for bulky handles or protruding components that could hamper the user. Additionally, positioning the electronics within reusable portions of the shaver may help reduce long-term usage costs, as opposed to putting electronics in, e.g., the disposable cartridges.

As detailed to above, embodiments of the present disclosure contemplate one or more sensors (e.g., a switch 716) associated with a shaver 701 and configured to obtain data relating to number of strokes made with shaver 701, length of a shaving session, an area of a body shaved, duration of a shave stroke, and/or force applied to shaving cartridge 703 and, consequently, the skin shaved by a user. One or more processor(s) 730/750 may be configured to analyze (via suitable algorithms) data associated with switch 716 opening and closing, as well as a time period associated with each open and/or close of switch 716 to determine the length of a shave session. In some embodiments, the information determined from the data obtained from switch 716 may be displayed to a user via, e.g., a screen on a smartphone, smart device, and/or computer. The data may also be transmitted to a suitable third party, e.g., a manufacturer of shaver 701 or components thereof.

An area of a body shaved by comparing a number of shave strokes and stroke duration (e.g., obtained from analyze the opening and closing of switch 716 during a given session) to historical data. For example, it is contemplated that a shaving session for an underarm may generally comprise 20% of the shave strokes generally associated with a shaving session for a face.

All technical and scientific terms used herein have the same meaning as commonly understood to one of ordinary skill in the art to which this disclosure belongs unless clearly indicated otherwise. As used herein the singular forms "a", "an", and "the" include plural references unless the context clearly dictates otherwise. Thus, for example, reference to "a sensor" may include a plurality of such sensors and reference to "the sensor" may include reference to one or more sensors and equivalents thereof known to those skilled in the art, and so forth.

The many features and advantages of the present disclosure are apparent from the detailed specification, and thus, it is intended by the appended claims to cover all such features and advantages of the present disclosure that fall within the true spirit and scope of the disclosure. Further, since numerous modifications and variations will readily occur to those skilled in the art, it is not desired to limit the present disclosure to the exact construction and operation illustrated and described, and accordingly, all suitable modifications and equivalents may be resorted to, falling within the scope of the present disclosure.

Moreover, those skilled in the art will appreciate that the conception upon which this disclosure is based may readily be used as a basis for designing other structures, methods, and systems for carrying out the several purposes of the present disclosure. Accordingly, the claims are not to be considered as limited by the foregoing description.

The invention claimed is:

1. A shaving system, comprising:

a shaver having a handle, a razor cartridge having 1) a leading edge, and a trailing edge substantially parallel to the leading edge, and 2) a first side, and a second side substantially parallel to the first side, wherein the first side and second side are each substantially perpendicular to each of the leading edge and the trailing edge, and two first sensors, wherein each first sensor includes a socket and a ball rotatable within the socket and is configured to detect a characteristic of the shaver or a body part of a user and to generate a sensor signal representative of the characteristic, wherein one first sensor is positioned adjacent the first side of the razor cartridge, and another first sensor is positioned adjacent the second side of the razor cartridge;

a processor operably coupled to the first sensors and having at least one algorithm stored thereon for analyzing sensor signals to determine a status of a shaving session, wherein the processor is configured to generate an alert through a smart device application, audio, lights, and/or vibration that the shaver has exceeded a usage threshold or to automatically place an order for one or more new shaving components by contacting a merchant unit when a determined number of shaving strokes exceeds the usage threshold, wherein the usage threshold is based on rotation of the ball, and wherein the processor also is configured to determine that a shaving stroke includes a component of side-to-side movement in a direction parallel to blades of the razor cartridge, and generate an alert through the smart device application, audio, lights, and/or vibration to i) adjust a shave stroke or ii) change a direction of movement of the shaver, based on the determination that the shaving stroke includes a component of side-to-side movement; and an indicator operably coupled to the processor, wherein the indicator is configured to provide feedback to the user regarding the status of the shaving session.

2. The system of claim 1, wherein the shaver includes a second sensor, and the second sensor includes a proximity sensor.

3. The system of claim 2, wherein the first sensors are located on the razor cartridge and the second sensor is located on the handle or on the razor cartridge.

4. The system of claim 1, wherein the processor or the indicator is located on a base, wherein the base is separate from the shaver.

5. The system of claim 1, wherein the processor or the indicator is incorporated as part of the shaver.

6. A shaving system, comprising:

a handle;

a cartridge including a skin-contacting surface coupled to the handle, wherein the cartridge includes 1) a leading edge, and a trailing edge substantially parallel to the leading edge, and 2) a first side, and a second side substantially parallel to the first side, wherein the first side and second side are each substantially perpendicular to each of the leading edge and the trailing edge;

one or more blades coupled to the skin-contacting surface;

one or more sensors, at least four of the one or more sensors includes a socket and a ball rotatable within the socket and is configured to detect movement of the skin-contacting surface relative to a skin surface of a user, or a force exerted by the skin-contacting surface against the skin surface of the user, wherein:

a first sensor of the one or more sensors is disposed adjacent to the first side and the trailing edge, a second sensor of the one or more sensors is disposed adjacent to the second side and the trailing edge a third sensor of the one or more sensors is disposed adjacent to the first side and the leading edge, and a fourth sensor of the one or more sensors is disposed adjacent to the second side and the leading edge; and a processor operably coupled to the one or more sensors, the processor is configured to determine a number of shaving strokes taken with the one or more blades based at least in part on rotation of the ball within the socket, wherein the processor is further configured to determine a bias of a user of the shaving system toward one or more of the first side, the second side, the leading edge, or the trailing edge based on data received from each of the first sensor, the second sensor, the third sensor, and the fourth sensor.

7. The system of claim 6, wherein the processor is configured to generate an alert through a smart device application, audio, lights, and/or vibration, that the shaving system has exceeded a usage threshold or to automatically place an order for one or more new shaving components by contacting a merchant unit when the determined number of shaving strokes exceeds the usage threshold.

8. The system of claim 6, wherein the processor is configured to analyze a shaving technique of a user based on the detected movement.

9. The system claim 8, wherein the processor is configured to generate an alert delivered through one or more feedback mechanisms to notify a user of suboptimal shaving technique based on at least one of a length of a shaving stroke of the user, a frequency of shaving strokes of the user, a tempo of shaving strokes of the user, or a force of the shaving strokes of the user.

10. The system of claim 6, wherein the one or more sensors includes an additional sensor, wherein the additional sensor includes a proximity sensor.

11. The system of claim 10, wherein the additional sensor is located on the handle or on the cartridge.

12. The system of claim 10, wherein the additional sensor is located on the one or more blades.

13. The system of claim 6, wherein the processor is located on a base, wherein the base is separate from a shaver, wherein the shaver is comprised of the handle, the cartridge, the one or more blades, and the one or more sensors.

14. The system of claim 6, wherein the processor is located on either a phone or a computer.

* * * * *